US005688290A

United States Patent [19]

Bjork et al.

[11] Patent Number: 5,688,290

[45] Date of Patent: *Nov. 18, 1997

[54] DEGRADATION RESISTANT DETERGENT COMPOSITIONS BASED ON CELLULASE ENZYMES

[75] Inventors: Nancy Bjork; Kathleen A. Clarkson, both of San Francisco; Pushkaraj J. Lad, San Mateo; Geoffrey L. Weiss, San Francisco, all of Calif.

[73] Assignee: Genencor International, Inc., Palo Alto, Calif.

[ * ] Notice: The term of this patent shall not extend beyond the expiration date of Pat. No. 5,120,463.

[21] Appl. No.: 262,390

[22] Filed: Jun. 20, 1994

Related U.S. Application Data

[63] Continuation of Ser. No. 876,927, May 1, 1992, abandoned, which is a continuation-in-part of Ser. No. 686,265, Apr. 15, 1991, Pat. No. 5,120,463, which is a continuation of Ser. No. 422,814, Oct. 19, 1989.

[51] Int. Cl.[6] ..... C11D 3/386; D06M 15/00

[52] U.S. Cl. ..... 8/401; 510/320; 510/392; 510/530; 435/263; 435/264; 8/137

[58] Field of Search ..... 252/174.12, DIG. 12, 252/209; 435/263, 264; 8/137, 401; 510/320, 392, 530

[56] References Cited

U.S. PATENT DOCUMENTS

| | | | |
|---|---|---|---|
| 4,275,163 | 6/1981 | Gallo | 435/209 |
| 4,435,307 | 3/1984 | Barbesgaard et al. | 252/174.12 |
| 4,472,504 | 9/1984 | Gallo | 435/209 |
| 4,479,881 | 10/1984 | Tai | 252/8.8 |

(List continued on next page.)

FOREIGN PATENT DOCUMENTS

| | | | |
|---|---|---|---|
| 0173397 | 6/1984 | European Pat. Off. . | |
| 0137280 | 7/1984 | European Pat. Off. . | |
| 0120528 | 10/1984 | European Pat. Off. . | |
| 0244234 | 4/1986 | European Pat. Off. . | |
| 0271004 | 12/1986 | European Pat. Off. . | |
| 0220016 | 4/1987 | European Pat. Off. . | |
| 2148278 | 9/1984 | Germany . | |
| 58-36217 | 3/1983 | Japan . | |
| 58-54082 | 3/1983 | Japan . | |
| 62-062898 | 3/1987 | Japan . | |
| 64-40681 | 10/1989 | Japan . | |
| 1368599 | 10/1974 | United Kingdom | 252/174.12 |
| 2094826 | 9/1982 | United Kingdom . | |
| 2095275 | 9/1982 | United Kingdom . | |
| 85/04672 | 10/1985 | WIPO . | |
| 8909259 | 10/1989 | WIPO | 252/174.12 |
| 9105841 | 5/1991 | WIPO | 252/174.12 |

OTHER PUBLICATIONS

S. Aho, "Structural and functional analysis of *Trichoderma reesei* endoglucanase I expressed in yeast *Saccharomyces cerevisiae*", *FEBS Letters*, vol. 291, pp. 45–49 (1991).

Berg et al., "Enzyme–Gold Affinity Labelling of Cellulose", *Journal of Electron Microsc. Tech.*, vol. 8, pp. 371–379, (1988) [Abstract].

Bhat et al., *Carbohydrate Research*, vol. 190, pp. 279–297 (1989).

Brown et al., "Microbial Enzymes and Lignocellulose Utilization," *Genetic Control of Environmental Pollutants*, Omen Editor, Plenum Publishing Corp., pp. 239–265 (1984).

(List continued on next page.)

*Primary Examiner*—Margaret Einsmann
*Assistant Examiner*—Kery Fries
*Attorney, Agent, or Firm*—Burns, Doanes, Swecker & Mathis, L.L.P.

[57] ABSTRACT

Disclosed are detergent compositions containing a combination of exo-cellobiohydrolase I type cellulase components and endoglucanase type components wherein the exo-cellobiohydrolase I type cellulase components are enriched relative to the endoglucanase type components. The detergent compositions of this invention provide cleaning and softening of cotton garments while also providing substantially reduced degradation of the cotton fabric in the garment.

27 Claims, 5 Drawing Sheets

U.S. PATENT DOCUMENTS

| | | | |
|---|---|---|---|
| 4,487,831 | 12/1984 | Day et al. | 435/99 |
| 4,648,979 | 3/1987 | Parslow et al. | 252/8.8 |
| 4,661,289 | 4/1987 | Parslow et al. | 252/547 |
| 4,725,544 | 2/1988 | Tan et al. | 435/200 |
| 4,738,682 | 4/1988 | Boegh et al. | 8/401 |
| 4,762,788 | 8/1988 | Warzywoda et al. | 435/209 |
| 4,797,361 | 1/1989 | Montenecourt | 435/198 |
| 4,822,516 | 4/1989 | Suzuki et al. | 252/174 |
| 4,832,864 | 5/1989 | Olson | 252/174.12 |
| 4,894,338 | 1/1990 | Knowles et al. | 435/172 |
| 4,912,056 | 3/1990 | Olson | 435/263 |
| 4,945,053 | 7/1990 | Ito et al. | 435/209 |
| 4,952,505 | 8/1990 | Cho | 435/209 |
| 4,978,470 | 12/1990 | Suzuki et al. | 252/174.12 |
| 5,006,126 | 4/1991 | Olson et al. | 8/401 |
| 5,045,464 | 9/1991 | Ito et al. | 435/209 |
| 5,120,463 | 6/1992 | Bjork et al. | 252/174.12 |

OTHER PUBLICATIONS

Chen et al., "Nucleotide Sequence and Deduced Primary Structure of Cellobiohydrolase II from *Trichoderma reesei*", *Biotechnology*, vol. 5, pp. 274–278 (1987).

Coughlan et al., "Comparative Biochemistry of Fungal and Bacterial Cellulolytic Enzyme Systems", *Biochemistry and Genetics of Cellulose Degradation*, Aubert et al., Editors, pp. 11–30 (1988).

Hakansson et al., *Biochimica et Biophysica Acta* vol. 524, pp. 385–392 (1978).

Hakanssan, Dissertation, Faculty of Science, Uppsala University, pp. 6–23 (1981).

Harkki et al., "Genetic engineering of Trichoderma to produce strains with novel cellulase profiles", *Enzyme Microb. Technol.*, vol. 13, pp. 227–233 (1991).

Hayashia et al., "Cellulases of *Humicola insolens* and *Humicola grisea*", *Methods in Enzymology*, vol. 160, pp. 323–332 (1988).

Hayashida et al., "Production and Purification of Thermostable Cellulases from *Humicola insolens* YH–8", *Agri. Biol. Chem.*, vol. 44(8), pp. 1721–1728 (1980).

Hayashida et al., "The Role of Carbohydrate Moiety on Thermostability of Cellulases from *Humicola insolens* YH–8", *Agri. Biol. Chem.*, vol. 44(3) pp. 481–487 (1980).

*International Textile Bulletin, Dyeing/Printing/Finishing*, 2nd Quarter, pp. 5–8 (1990).

*JTN*, "Weight Loss Treatment to Soften the Touch of Cotton Fabric", p. 64 (Dec. 1988).

Kenkyushitsu et al., "The Improvement of Cellulose Fibers by Means of Cellulase".

Knowles et al., "The use of gene technology in the development of novel cellulolytic organisms–*Trichoderma reesei* cellulase and cellulobiohydrolase gene cloning and expression; a review", *Recent Adv. Biotechnol. Appl. Biol.*, pp. 139–142 (1988) [Abstract].

Knowles et al., "The use of gene technology to investigate fungal cellulolytic enzymes *Trichoderma reesei* cellulase complex gene cloning and expression in *Saccharomyces cerevisiae*", *FEMS Symp.* 43, pp. 153–169 (1988) [Abstract].

Kubicek–Pranz et al., "Transformation of *Trichoderma reesei* with cellobiohydrolase II gene as a means for obtaining strains with increased cellulase production and specific activity", *Journal of Biotechnology*, vol. 20, pp. 83–94 (1991).

Kubicek–Pranz et al., "Characterization of Commercial *Trichoderma–reesei* Cellulase Preparations by Denaturing Electrophoresis SDS–PAGE and Immunostaining Using Monoclonal Antibodies", *Biotechnol. Appl. Biochem.*, vol. 14, pp. 317–323 (1991) [Abstract].

Luderer et al., "A Re–appraisal of Multiplicity of Endoglucanase I from *Trichoderma reesei* Using Monoclonal Antibodies and Plasma Desorption Mass Spectrometry", *Biochim. Biophys. Acta*, vol. 1076, pp. 427–434 (1991) [Abstract].

Miller et al., "Direct and Indirect Gene Replacements in *Aspergillus nidulans*, " *Mol. and Cell. Biol.*, vol. 5(7), pp. 1714–1721 (1985).

Murphy–Holland et al., "Secretion activity and stability of deglycosylated cellulase of *Trichoderma reesei* gene cloning", *Abstr. Annu. Meet. Am. Soc. Microbiol.*, 85 Meet., 193 (1985) [Abstract].

Ohishi et al., "Reformation of Cotton Fabric by Cellulase;" pp. 1–12.

Penttilla et al., "Homology between cellulase genes of *Trichoderma reesei*: complete nucleotide sequence of the endoglucanase I gene", *Gene*, vol. 45, pp. 253–263 (1986).

Penttillä et al., "Expression of two *Trichoderma reesei* Endoglucanases in the Yeast *Saccharomyces cerevisiae*", *Yeast*, vol. 3, pp. 175–185 (1987).

Reinikainen et al., "How Do *Trichoderma reesei* cellobiohydrolase bind to and degrade cellulose", *Abstr. Pap. Am. Chem. Soc.*, 202 Meet. Pt. 1 (1991) [Abstract].

Saloheimo et al., "EGIII a new endoglucanase from *Trichoderma reesei*: the characterization of both gene and enzyme", *Gene*, vol. 63, pp. 11–22 (1988).

Sambrook et al., *Molecular Cloning A Laboratory Manual*, 2nd Ed., Cold Spring Harbor Laboratory Press, pp. 1.53–1.73 (1989).

Schulein, "Cellulases of *Trichoderma reesei*", *Methods in Enzymology*, vol. 160, pp. 234–242 (1988).

Sheir–Neiss et al., "Characterization of the Secreted Celluloses of *Trichoderma reesei* Wild Type and Mutants During Controlled Permentations", *Appl. Microbiol. Biotechnol.*, vol. 20, pp. 46–53 (1984).

Shoemaker et al., "Molecular Cloning of Exo–cellobiohydrolase I Derived from *Trichoderma reesei* Strain L27", *Biotechnology*, vol. I, pp. 691 (1983).

Shoemaker et al., "Characterization and Properties of Cellulases Purified from *Trichoderma reesei* Strain L27", *Biotechnology*, pp. 687–690 (1983).

Teeri, "The Cellulolytic Enzyme System of *Trichoderma reesei*," *Publications 38*, pp. 13, 17–20 of 1–52 + Appendices (1987).

Teeri et al., "Engineering Trichoderma and its cellulases *Trichoderma reesei* cellulase and cellobiohydrolase gene cloning and expression: potential strain and improvement and enzyme engineering" *Trichoderma reesei Cellulases*, pp. 156–163 (1990) [abstract].

Ulker et al., "Characterization of an Unglycosylated Low Molecular Weight 1,4–B–gencanglucanahydrolose of *Trichoderma reesei*", *FEMS Microbiology Letters*, vol. 69, pp. 215–219 (1990).

Uusitalo et al., "Enzyme Production by recombinant *Trichoderma reesei* strains" *Journal of Biotechnology*, vol. 17, pp. 35–49 (1991).

Voragen et al., "Cellulose of a Mutant Strain of Trichodema Uride QM 9414", *Methods in Enzymology*, vol. 160, pp. 243–251 (1988).

Wood "Properties of Cellulolytic Enzyme Systems", *Biochem. Soc. Trans.*, vol. 13, pp. 407–410 (1985).

Wood et al., "Aerobic and Anaerobic Fungal Cellulases, With Special Reference to Their Mode of Attack on Crystalline Cellulose", *Biochemistry and Genetics of Cellulose Degradation*, pp. 31–52 (1988).

Wood et al., "Methods for Measuring Cellulase Activities", *Methods in Enzymology*, vol. 160, pp. 87–112 (1988).

Wood et al., "The Mechanism of Fungal Cellulose Action", *Biochem. J.*, vol. 260, pp. 37–43 (1989).

Yamagishi, "Reforming of Cellulosic Fiber With Cellulose", *The Shizuoka Prefectural Hamamatsu Textile Industrial Research Institute Report* vol. 24, pp. 54–61 (1986).

DEGRADATION RESISTANT DETERGENT COMPOSITIONS BASED ON CELLULASE ENZYMES

CROSS-REFERENCE TO RELATED APPLICATIONS

This application is a continuation of application Ser. No. 07/876,927, filed May 1, 1992 now abandoned, which is a continuation-in-part of U.S. patent application Ser. No. 07/686,265, filed Apr. 15, 1991, now U.S. Pat. No. 5,120,463 which is a continuation of U.S. patent application Ser. No. 07/422,814, filed Oct. 19, 1989, the disclosure of each of which is incorporated herein by reference in its entirety.

BACKGROUND OF THE INVENTION

1. Field of Invention

The present invention relates to detergent compositions which have improved degradation resistance to cotton fabrics. More particularly, the present invention relates to detergent compositions containing a cellulase composition comprising a combination of exo-cellobiohydrolase I type cellulase components and endoglucanase cellulase components wherein the exo-cellobiohydrolase I type cellulase components are enriched relative to the endoglucanse type cellulase components. Such detergent compositions provide excellent cleaning, especially of cotton garments, while also providing substantially reduced degradation of the cotton fabric in the garment.

2. State of the Art

Cellulases are known in the art as enzymes that hydrolyze cellulose (β-1,4-glucan linkages) thereby resulting in the formation of glucose, cellobiose, cellooligosaccharide, and the like. While cellulases are produced in fungi, bacteria and the like, those produced by fungi have been given the most attention because fungi typically produce a complete cellulase system capable of degrading crystalline forms of cellulose, and such cellulases can be readily produced in large quantities via fermentation procedures.

In regard to the above, "Methods in Enzymology", 160, 25, pages 234–242 (1988) discloses that certain fungi produce cellulase systems which are comprised of several different enzyme components including those identified as exo-cellobiohydrolases (EC 3.2.1.91) ("CBH"), endoglucanases (EC 3.2.1.4) ("EG"), β-glucosidase (EC 3.2.1.21) ("BG"). Moreover, these classes can be further separated into individual components. For example, multiple CBHs and EGs have been isolated from a variety of bacterial and fungal sources including *T. longibrachiatum* which contains 2 CBHs, i.e., CBH I and CBH II, and at least 3 EGs, i.e., EG I, EG II and EG III. The ratio of CBH I type components to EG type components (including all of the EG type components) in naturally occurring cellulases does not appear to exceed about 5:1. For example, see Brown et al., *Genetic Control of Environmental Pollutants*, Gilbert S. Omenn Editor, Chapter—"Microbial Enzymes and Ligno-Cellulase Utilization", Hollaender Publishing Corp. Variations in this ratio can result from the use of different microorganisms, depending upon the characteristics of the strain, but in any event such ratios still do not exceed about 5:1.

The complete cellulase system comprising CBH, EG and BG is required to efficiently convert crystalline cellulose to glucose. Isolated components are far less effective, if at all, in hydrolyzing crystalline cellulose. Moreover, a synergistic relationship is observed between the cellulase components.

That is to say the effectiveness of the complete system is significantly greater than the sum of the contributions from the isolated components. It has also been suggested by Wood, "Properties of Cellulolytic Systems", *Biochem. Soc. Trans.*, 13, 407–410 (1985), that CBH I and CBH II derived from either *T. reesei* or *P. funiculosum* synergistically interact in solubilizing cotton fibers. On the other hand, Shoemaker et al., Bio/Technology, October 1983, disclose that CBH I (derived from *T. longibrachiatum*), by itself, has the highest binding affinity but the lowest specific activity of all forms of cellulase.

The substrate specificity and mode of action of the different cellulase components varies from component to component which may account for the synergy of the combined components. For example, the current accepted mechanism of cellulase action is that endoglucanase components hydrolyze internal β-1, 4-glucosidic bonds particularly in regions of low crystallinity of the cellulose and exo-cellobiohydrolase components hydrolyse cellobiose from the non-reducing end of the cellulose. β-Glucosidase components act on cellooligosaccharides, e.g., cellobiose, to give glucose as the sole product.

Cellulases are also known in the art to be useful in detergent compositions either for the purpose of enhancing the cleaning ability of the composition or as a softening agent. When so used, the cellulase will degrade a portion of the cellulosic material, e.g., cotton fabric, in the wash, which in one manner or another facilitates the cleaning and/or softening of the cotton fabric. While the exact cleaning mechanism of cotton fabrics by cellulase is not fully understood, the cleaning of cotton fabrics by cellulase has been attributed to its cellulolytic activity. Thus, for instance, U.S. Pat. No. 4,822,516 discloses that detergent compositions containing a cellulase having low activity on highly crystalline cellulose and high activity on low crystalline cellulose possesses good detergency and a low degree of damage on cotton garments. As noted by Wood, supra, the presence of CBH components is the distinguishing feature of cellulases that are able to degrade crystalline cellulose. Accordingly, these references would suggest that CBH components are in some form involved in the degradation of cotton fabric.

However, regardless of its cleaning and/or softening mechanism(s), the use of cellulases in detergent compositions is complicated by the fact that exposure of cotton garments to cellulase results in partial degradation of the cotton fabric in these garments. After repeated washing and drying, the integrity of the cotton garment is compromised resulting in the tearing, weakening and/or thinning of the cotton garment. When its integrity has been so compromised by repeated exposure to cellulase containing detergents, the cotton garment is no longer of any practical utility. Needless to say, such degradation greatly impairs the commercial utility of cellulases in detergent compositions. Accordingly, cellulase compositions have been sought which possess reduced cotton degradation while retaining enhanced cleaning capabilities.

Accordingly, it is an object of this invention to develop a detergent composition containing cellulase which is resistant to degrading cotton fabrics. It is a further object of this invention that such detergent compositions provide excellent cleaning of such cotton fabrics. These and other objects are achieved by the present invention as evidenced by the attached Summary of the Invention, Detailed Description of the Invention and Claims,

SUMMARY OF THE INVENTION

The present invention is directed to the discovery that detergent compositions containing cellulase compositions enriched in CBH I type cellulase components relative to the EG components provide cleaning and softening of cotton garments while at the same time having a reduced capacity for degrading cotton fabrics. Accordingly, in its composition aspects, the present invention is directed to detergent compositions comprising at least one surface active agent and a cleaning effective amount of a cellulase composition wherein said cellulase composition contains a weight ratio of CBH I type cellulase components to EG type components of greater than about 10:1. Such compositions are particularly useful as laundry detergents.

In one of its method aspects, the present invention is directed to a method for enhancing the softening properties of a detergent composition which comprises adding a softening effective amount of a cellulase composition containing a weight ratio of CBH I type cellulase components to EG type components of greater than about 10:1.

In another of its method aspects, the present invention is directed to a method for enhancing the degradation resistance to cotton fabric of a detergent composition containing cellulase which comprises employing a cellulase composition containing a weight ratio of CBH I type cellulase components to EG type components of greater than about 10:1.

BRIEF DESCRIPTION OF THE DRAWINGS

In FIG. 6, the right hand side of the figure is marked to indicate the location of the single proteins found in one or more of the secreted proteins. Specifically, BG refers to the β-glucosidase, E1 refers to endoglucanase I, E2 refers to endoglucanase II, E3 refers to endoglucanase III, C1 refers to exo-cellobiohydrolase I and C2 refers to exo-cellobiohydrolase II.

DETAILED DESCRIPTION OF THE INVENTION

Figure 1:
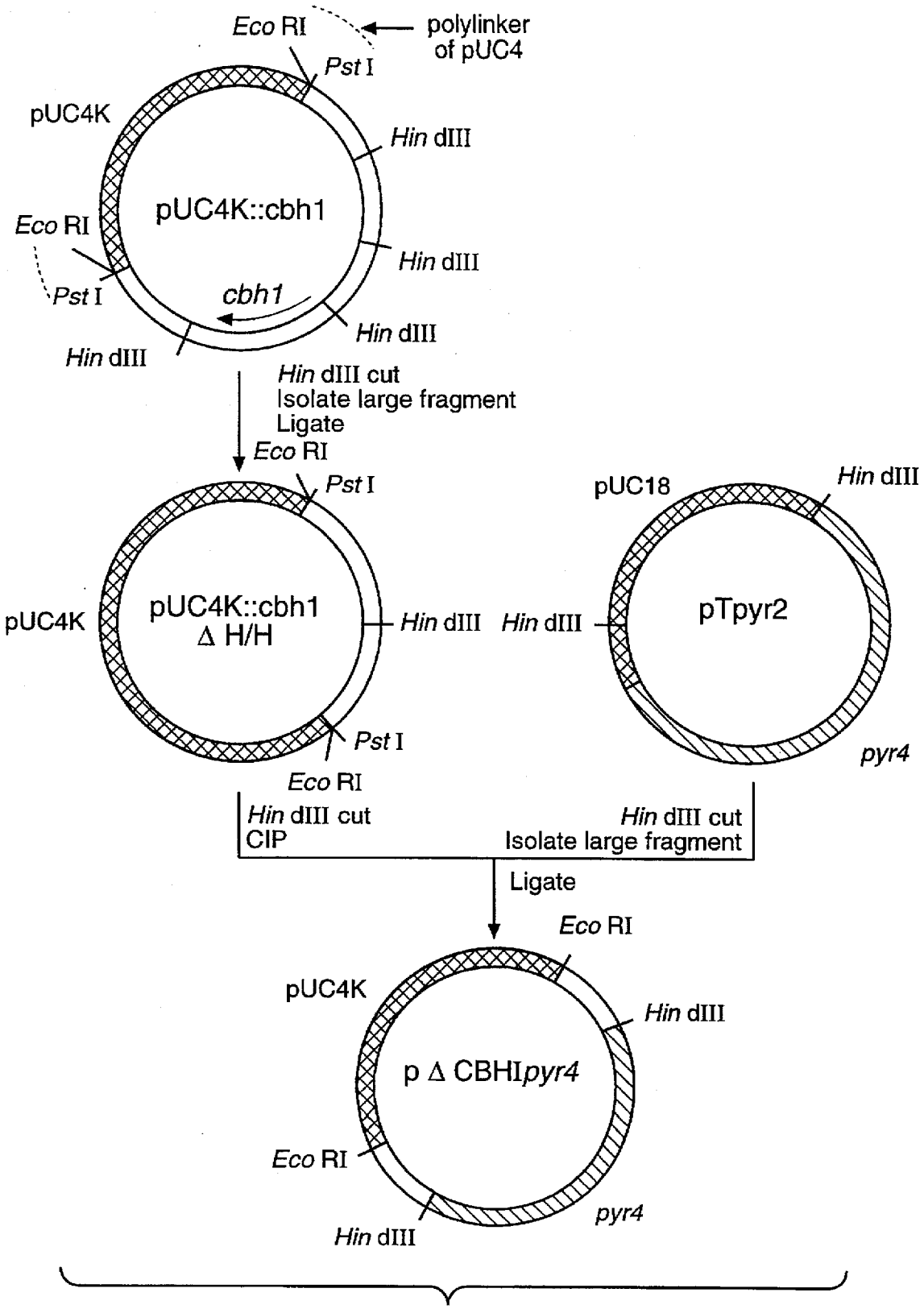
FIG. 1 is an outline of the construction of pΔCBHIpyr4.

As noted above, the present invention generally relates to detergent compositions containing a cellulase composition enriched in CBH I type cellulase components relative to the EG type components. Such detergent compositions possess excellent cleaning abilities and softening potential while exhibiting reduced degradation potential against cotton fabrics relative to detergent compositions containing a whole cellulase composition. The softening potential and reduced degradation potential against cotton fabrics possessed by the detergent compositions of this invention is surprising in view of the fact that the detergent compositions contain cellulase compositions enriched in CBH I type cellulase components. Specifically, while the art discloses that EG type components impart softening to cotton-containing fabrics there appears to be no teaching that CBH components can also impart softening in the presence of EG components.

Additionally, with regard to the reduced degradation potential of the compositions described herein, the presence of CBH I is the distinguishing feature of cellulases that are able to degrade crystalline cellulose which in turn has been implicated in the degradation of cotton fabric. Moreover, the excellent cleaning properties of the compositions of this invention are also surprising because CBH I (derived from *T. longibrachiatum*) has been shown to have the lowest specific activity of all cellulase components derived from *T. longibrachiatum on all forms of cellulose.*

However, prior to discussing this invention in detail, the following terms will first be defined.

Definitions

The term "cellulase" or "cellulase composition" refers to an enzyme composition derived from fungal sources or microorganisms genetically modified so as to incorporate and express all or part of the cellulase genes obtained from a fungal source (sometimes referred to hereafter as "fungal cellulases"). Cellulases act on cellulose or one or more of its degradation products to hydrolyze cellulose and give primary products, glucose and cellobiose. Fungal cellulases are distinguished from cellulases produced from non-fungal sources including microorganisms such as actinomycetes, gliding bacteria (myxobacteria) and true bacteria. Fungi capable of producing cellulases useful in preparing cellulase compositions used in the detergent compositions described herein are disclosed in British Patent No. 2 094 826A, the disclosure of which is incorporated herein by reference.

Most cellulases generally have their optimum activity in the acidic or neutral pH range although some fungal cellulases are known to possess significant activity under neutral and slightly alkaline conditions, for example, cellulase derived from *Humicola insolens* is known to have activity in neutral to slightly alkaline conditions.

Cellulases are known to be comprised of several enzyme classifications having different substrate specificity, enzymatic action patterns, and the like. Additionally, enzyme components within each classification can exhibit different molecular weights, different degrees of glycosylation, different isoelectric points, different substrate specificity, different enzymatic action patterns, etc. For example, cellulases can contain cellulase classifications which include endoglucanases (EGs), exo-cellobiohydrolases (CBHs), β-glucosidases (BGs), etc. On the other hand, while bacterial cellulases are reported in the literature as containing little or no CBH components, there are a few cases where CBH-like components derived from bacterial cellulases have been reported to possess exo-cellobiohydrolase activity.

A cellulase composition produced by a naturally occurring fungal source, and which comprises one or more CBH and EG components, wherein each of these components is found at the ratio produced by the fungal source is sometimes referred to herein as a "complete cellulase system" or a "complete cellulase composition" to distinguish it from the classifications and components of cellulase isolated therefrom, from incomplete cellulase compositions produced by bacteria and some fungi, or from a cellulase composition obtained from a microorganism genetically modified so as to overproduce, underproduce or not produce one or more of the CBH and/or EG components of cellulase.

The fermentation procedures for culturing fungi for production of cellulase are known per se in the art. For example, cellulase systems can be produced either by solid or submerged culture, including batch, fed-batch and continuous-flow processes. The collection and purification of the cellulase systems from the fermentation broth can also be effected by procedures known per se in the art.

"Endoglucanase ("EG") type components" refer to all of those cellulase components or combination of components which exhibit detergent activity properties similar to the endoglucanase components of *Trichoderma longibrachiatum*. In this regard, the endoglucanase components of *Trichoderma longibrachiatum* (specifically, EG I, EG II, EG III, and the like, either alone or in combination) impart softening, color retention/restoration and improved feel to cotton-containing fabrics when these components are incorporated into a wash medium and the fabric is treated with this medium. Accordingly, endoglucanase type components are those cellulase components which impart softening, color retention/restoration and improved feel to cotton garments when these components are incorporated into a wash medium. The endoglucanase type components employed in the detergent compositions of this invention also impart less strength loss to cotton-containing fabrics as compared to complete cellulassing from the complete cellulase system derived from *Trichoderma longibrachiatum*.

Such endoglucanase type components may not include components classified as endoglucanases using traditional biochemical activity tests. For example, such traditional activity tests are based on the ability of the component (a) to hydrolyze soluble cellulose derivatives such as carboxymethylcellulose (CMC), thereby reducing the viscosity of CMC containing solutions, and (b) to readily hydrolyze hydrated forms of cellulose such as phosphoric acid swollen cellulose (e.g., Walseth cellulose) and hydrolyze less readily the more highly crystalline forms of cellulose (e.g., Avicel, Solkafloc, etc.). In contrast, it is believed that not all endoglucanase components, as defined by such activity tests, will provide improved softness, feel and color retention/restoration. Accordingly, it is more accurate for the purposes herein to define endoglucanase type components as those components of fungal cellulase which possess similar properties in detergent compositions as possessed by the endoglucanase components of *Trichoderma longibrachiatum*.

Cellulases can contain more than one EG type component. The different components generally have different isoelectric points, different molecular weights, different degrees of glycosylation, different substrate specificity, different enzymatic action patterns, etc. The different isoelectric points of the components allow for their separation via ion exchange chromatography and the like. In fact, the isolation of components from different fungal sources is known in the art. See, for example, Schulein et al., International Patent Application WO 89/09259, Wood et al., *Biochemistry and Genetics of Cellulose Degradation*, pp. 31 to 52 (1988); Wood et al., *Carbohydrate Research*, Vol. 190, pp. 279 to 297 (1989); Schulein, *Methods in Enzymology*, Vol. 160, pp. 234 to 242 (1988); and the like. The entire disclosure of each of these references is incorporated herein by reference.

In general, it is contemplated that combinations of EG type components may give a synergistic response in improving softening, color retention/restoration and feel as compared to a single EG type component. On the other hand, a single EG type component may be more stable or have a broader spectrum of activity over a range of pHs. Accordingly, the EG type components employed in this invention can be either a single EG type component or a combination of two or more EG type components. When a combination of components is employed, the EG type components may be derived from the same or different fungal sources.

"Exo-cellobiohydrolase type ("CBH type") components" refer to those fungal cellulase components which exhibit detergent activity properties similar to CBH I and/or CBH II components of *Trichoderma longibrachiatum*. In this regard, when used in the absence of EG type components (as defined above), the CBH I and CBH II components of *Trichoderma longibrachiatum* alone do not impart significant color retention/restoration and improved feel to the so-treated cotton-containing fabrics. Additionally, when used in combination with EG type components at concentrations of about 5:1 and greater, the CBH I component of *Trichoderma longibrachiatum* imparts an incremental cleaning effect to cotton-containing fabrics. However, as the concentration of EG type components is increased so that the CBH I type components to EG type components approach that of whole cellulase which has a ratio of about 2:5:1 enhanced strength loss occurs as compared to cellulase compositions containing a ratio of CBH I type to EG type components of greater than 5:1.

Accordingly, CBH I type components and CBH II type components refer to those fungal cellulase components which exhibit detergent activity properties similar to CBH I and CBH II components of *Trichoderma longibrachiatum*, respectively.

Further, "CBH I type components" refer to those components which exhibit similar cleaning performance as that exhibited by CBH I derived from *T. longibrachiatum* when combined with EG components. Preferably, this includes the properties of reducing strength loss of cotton-containing fabrics and/or imparting an incremental cleaning benefit when used in the presence of EG type components at the ratios recited above. In a preferred embodiment, the CBH I components also impart an incremental softening benefit when used in the presence of EG type components.

"CBH II type cellulase components" refer to those components which exhibit exocellobiohydrolase activity similar to that of CBH II derived from *T. longibrachiatum*. Accordingly, the cellulase composition employed in the detergent compositions of the present invention can contain CBH II type cellulase components in addition to CBH I type cellulase components and EG components. When so employed, the amount of CBH II type cellulase components is generally from about 0.001 to about 30 weight percent relative to the CBH I type cellulase component in the detergent compositions. However, in the preferred embodiment, the cellulase composition contains no CBH II type cellulase components. In fact, our results indicate that CBH II, when employed at the same concentrations as CBH I, will not demonstrate the same cleaning benefits when combined with EG components that CBH I type cellulase components do. It is, however, contemplated that CBH II may provide softening when combined with EG components.

Such exo-cellobiohydrolase type components may include components not traditionally classified as exo-cellobiohydrolases using activity tests such as those used to characterize CBH I and CBH II from *Trichoderma longibrachiatum*. For example, using such traditional classification tests, such components are: (a) competitively inhibited by cellobiose ($K_i$ approximately 1 mM); (b) unable to hydrolyze to any significant degree substituted celluloses, such as carboxy-methylcellulose, etc.; and (c) able to hydrolyze phosphoric acid swollen cellulose and to a lesser degree highly crystalline cellulose. In contrast, it is believed that some fungal cellulase components which are characterized as CBH components by such activity tests, will provide improved softness, feel and color retention/restoration to cotton-containing fabrics when these components are used alone in detergent compositions. Accordingly, it is believed to be more accurate for the purposes herein to define such exo-cellobiohydrolases as EG type components because these components possess similar functional properties in detergent compositions as possessed by the endoglucanase components of *Trichoderma longibrachiatum*.

"β-Glucosidase (BG) components" refer to those components of cellulase which exhibit BG activity; that is to say that such components will act from the non-reducing end of cellobiose and other soluble cellooligosaccharides ("cellobiose") and give glucose as the sole product. BG components do not adsorb onto or react with cellulose polymers. Furthermore, such BG components are competitively inhibited by glucose ($K_i$ approximately 1 mM). While in a strict sense, BG components are not literally cellulases because they cannot degrade cellulose; such BG components are included within the definition of the cellulase system because these enzymes facilitate the overall degradation of cellulose by further degrading the inhibitory cellulose degradation products (particularly cellobiose) produced by the combined action of CBH components and EG components. Without the presence of BG components, moderate or little hydrolysis of crystalline cellulose will occur. BG components are often characterized on aryl substrates, such as p-nitrophenol B-D-glucoside (PNPG) and, thus, are often called aryl-glucosidases. It should be noted that not all aryl-glucosidases are BG components, in that some do not hydrolyze cellobiose.

It is contemplated that the presence or absence of BG components in the cellulase composition can be used to regulate the activity of the CBH components. Specifically, because cellobiose is produced during cellulose degradation by CBH components, and because high concentrations of cellobiose are known to inhibit CBH activity, and further because such cellobiose is hydrolyzed to glucose by BG components, the absence of BG components in the cellulase composition will "turn-off" CBH activity when the concentration of cellobiose reaches inhibitory levels. It is also contemplated that one or more additives (e.g., cellobiose, glucose, etc.) can be added to the cellulase composition to effectively "turn-off" directly or indirectly, some or all of the CBH I type activity, as well as other CBH activity. On the other hand, a cellulase composition containing added amounts of BG components may increase overall hydrolysis of cellulose, if the level of cellobiose generated by the CBH components becomes restrictive of such overall hydrolysis in the absence of added BG components.

Methods to either increase or decrease the amount of BG components in the cellulase composition are disclosed in U.S. Ser. No. 07/807,028 filed Dec. 10, 1991, as Attorney Docket No. 010055-077, and entitled "IMPROVED SACCHARIFICATION OF CELLULOSE BY CLONING AND AMPLIFICATION OF THE β-GLUCOSIDASE GENE FROM TRICHODERMA REESEI", which application is incorporated herein by reference.

Fungal cellulases can contain more than one BG component. The different components generally have different isoelectric points which allows for their separation via ion exchange chromatography, and the like. Either a single BG component or a combination of BG components can be employed.

When employed in the detergent composition, the BG component is generally added in an amount sufficient to prevent inhibition of the CBH and EG components and, particularly, CBH I type cellulase components by cellobiose. The amount of BG component added depends upon the amount of cellobiose produced in the detergent wash which can be readily determined by the skilled artisan.

"Degradation Resistant" refers to the diminished capacity of a detergent composition containing a cellulase composition of this invention to degrade cotton fabric. In general, degradation of cotton fabric by a cellulase containing detergent is measured by the degree of thinning, weakening and/or tearing produced in the cotton fabric over a repeated number of washings with the cellulase containing detergent followed after each washing with drying in a mechanical dryer. In this regard, it appears that the use of a mechanical dryer after washing facilitates this analysis insofar as the movement of the dryer during its operation stretches and pulls the garment, which, if substantially degraded, can result in tearing of the fabric. The degradation resistance of detergent compositions containing the cellulase components, as per this invention, can be readily determined by measuring the degradation of identical sets of cotton clothing or cotton swatches after a repeated number of washing/drying cycles under identical conditions. One set being washed with the detergent composition of this invention, and the other being washed with a detergent composition containing a cellulase system (preferably produced from the same organism) having a ratio of CBH I type cellulase components to EG components of about 2.5:1. At the completion of at least 20 washing/drying cycles, the sets of cotton clothing are evaluated for degradation. Degradation is measured by testing the tensile strength of each garment/swatch for each set, and a summation of all of the ratings for each set is then divided by the number of garments/swatches in the set so as to provide an average tensile strength. In this regard, in a preferred embodiment, the term "degradation resistant" means that the average tensile strength after at least 20 washing/drying cycles for the set of garments/swatches treated with the detergent composition of this invention is significantly higher than the average tensile strength of the set of garments/swatches treated with a detergent composition containing the cellulase system described above. Preferably, the detergent compositions of this invention will result in at least a 10% increase, and more preferably, a 20% increase in the average tensile strength for the set of garments/swatches treated with a detergent composition of this invention, as compared to the average tensile strength of the set of garments/swatches treated with a detergent composition containing the cellulase system described above.

Additionally, the degradation resistance of detergent compositions containing the cellulase components, as per this invention, can be determined by measuring the tensile strength in the warp and fill direction by the test method described in ASTM D 1682-64 which is incorporated herein by reference in its entirety.

Methodology

In accordance with the present invention, detergent compositions which employ a cellulase composition will be rendered degradation resistant if the cellulase composition employed in the detergent contains a weight ratio of CBH I type cellulase components to EG type components from greater than about 10:1 to 400:1. More preferably, the weight ratio of CBH I type cellulase components to EG type components is from about 20:1 to 100:1, and even more preferably, about 40:1 or more.

The detergent compositions of this invention will also result in reduced harshness (i.e., softening) of the washed garments. At higher weight ratios of CBH I components to EG components, the softening and cleaning effects of the cellulase compositions becomes more evident with repeated treatments.

Surprisingly, it has been found that it is the amount of cellulase and the ratio of CBH I type cellulase components to EG type components employed in detergent compositions and not the relative rate of hydrolysis of the individual enzymatic components in producing reducing sugars from cellulose which imparts the improved cleaning of cotton garments. Even more surprisingly, is the fact that CBH II type cellulase components do not substitute for CBH I type cellulase components (at the levels tested) in providing cleaning benefits when combined with EG type cellulase components in detergent compositions. Accordingly, when used to enhance the cleaning of fabrics, the amount of the cellulase composition generally employed in the detergent compositions of this invention is an amount sufficient to impart improved cleaning of cotton garments. Preferably, the cellulase compositions are employed from about 0.002 weight percent to about 10 weight percent relative to the total detergent composition. More preferably, the cellulase compositions are employed from about 0.01 weight percent to about 5 weight percent relative to the total detergent composition. The cellulase composition can be added to such detergent compositions either in a liquid diluent, or as granules, or as an emulsion. Such forms are well known to the skilled artisan. Preferably, the amount of cellulase composition employed in the detergent composition will be at least about 50 ppm, more preferably at least about 100 ppm.

The term "softening effective amount" means a sufficient amount of the cellulase composition employed in the detergent compositions of this invention to impart softening over one or more treatments with the cellulase containing detergent composition. Preferably, the amount of cellulase composition employed in the detergent compositions will be at least about 50 ppm, more preferably, at least about 100 ppm, and most preferably, at least about 250 ppm. At lower concentrations, it is contemplated that the softening effect of cellulase will be evident over repeated treatments of the fabric with the cellulase-containing detergent composition. As is apparent, these concentrations also provide enhanced cleaning of the fabrics.

It is contemplated that the CBH II component, when employed at the same concentrations as CBH I, may provide softening. As a further embodiment of this invention, the CBH II component is substituted for the CBH I component, when softening is desired. In the event that CBH II is used in the invention, in place of or in addition to the CBH I component, to provide a softening effective amount, the ratio of CBH I and CBH II components to EG components is preferably 10:1 and more preferably 20:1.

Without being limited to any theory, it is believed that the EG type components and/or CBH II type cellulase components in combination with the CBH I type components are primarily responsible for degrading cotton fabric. On the other hand, EG type components are required to provide the synergistic mixture of enzymes which results in improved cleaning and softening. However, the present invention is directed to the discovery that the desired increase in cleaning and softening can be achieved by using a detergent composition containing only small amounts of EG type component (s), i.e., less than that found in cellulases naturally produced by fungal microorganisms. Thus, by carefully controlling the amount of EG type components used in the cellulase employed in the detergent composition, one achieves a high level of cleaning and softening while at the same time reducing the degradation potential of the composition.

Cellulase compositions having the requisite ratio of CBH I type cellulase components to EG type cellulase components can be prepared by purifying the cellulase system into its components and then recombining the requisite amount of the components to achieve the desired ratio of components. In this manner, it is also possible to create cellulase compositions having little or no amounts of certain components, i.e., one can prepare a cellulase composition to be free of CBH II type cellulase components, or free of all EG type components except either EG-I type cellulase components (i.e., an cellulase component having properties similar to EG-I derived from *T. longibrachiatum*), EG-II type cellulase components (i.e., an cellulase component having endoglucanase properties similar to EG-II derived from *T. longibrachiatum*), or EG III type cellulase components (i.e., an cellulase component having endoglucanase properties similar to EG III derived from *T. longibrachiatum*) or free of BG components, merely by not recombining that (those) component(s). The cellulase compositions employed in the detergent compositions of this invention may be free of CBH II type cellulase components. In particular, CBH II type cellulase components, when employed at the same levels as CBH I, do not significantly enhance the cleaning properties of the detergent composition when enriched relative to the EG components.

The particular cellulase system employed to isolate the respective components is not critical, although certain cellulase systems may be preferred over others, i.e., an alkaline cellulase may be preferred over an acidic cellulase for use in laundry detergent compositions wherein the detergent wash solution is generally alkaline. On the other hand, an acid cellulase can be used in a pre-washing step in the appropriate solution or at an intermediate pH where sufficient activity to provide cleaning benefits still exists. Alternatively, the cellulase could be employed as a pre-soak either as a liquid or a spray, for example, as a spot remover.

Preferred cellulases for use in this invention are those obtained from *Trichoderma longibrachiatum*, *T. Koningii*, Pencillum sp., and the like. Certain cellulases are commercially available, i.e., CELLUCAST (available from Novo Industry, Copenhagen, Denmark), RAPIDASE (available from Gist Brocades, N.V., Delft, Holland), and the like. Other cellulases can be readily isolated by art recognized fermentation and isolation procedures.

Fungal cellulases enriched in CBH type components can be obtained by purification techniques. Specifically, the complete cellulase system can be purified into substantially pure components by recognized separation techniques well published in the literature, including ion exchange chromatography at a suitable pH, affinity chromatography, size exclusion, and the like. For example, in ion exchange chromatography (usually anion exchange chromatography), it is possible to separate the cellulase components by eluting with a pH gradient, or a salt gradient, or both a pH and a salt gradient.

Mixtures of cellulase components having the requisite ratio of CBH I type components to EG type cellulase components can be prepared by means other than isolation and recombination of the components. In this regard, it may be possible to modify the fermentation conditions for a natural microorganism in order to give relatively high ratios of CBH to EG components.

However, in this regard, many attempts to modify the fermentation conditions for a natural microorganism in order to give relatively high ratios of CBH to EG components have failed, likely because CBH and EG components are coordinately regulated by the microorganism.

Likewise, recombinant techniques, as set forth in the examples, can alter the relative ratio of CBH I components to EG components so as to produce a mixture of cellulase components having a relatively high ratio of CBH I component to EG components.

In regard to the above, a preferred method for the preparation of cellulase compositions enriched in CBH type components is by genetically modifying a microorganism so as to be incapable of producing one or more EG type components and/or overproducing CBH I type components preferably without producing any heterologous protein. For example, U.S. Ser. No. 07/770,049, filed Oct. 4, 1991 which is a continuation-in-part of U.S. Ser. No. 07/593,919, filed Oct. 5, 1990, both of which are incorporated herein by reference in their entirety, disclose methods for genetically engineering *Trichoderma longibrachiatum* so as to be incapable of producing one or more EG components and/or overproducing one or more CBH components. Moreover, the methods of that application create *Trichoderma longibrachiatum* strains which do not produce any heterologous proteins. U.S. Ser. No. 07/862,846 filed Apr. 3, 1992, Attorney Docket No. 010055–106, entitled "METHODS FOR PRODUCING SUBSTANTIALLY PURE EG III USING POLYETHYLENE GLYCOL," incorporated herein by reference, disclose methods of producing a *T. longibrachiatum* EG I and EG II deleted strain. Likewise, Miller et al., "Direct and Indirect Gene Replacement in *Aspergillus nidulans*", *Molecular and Cellular Biology*, p. 1714–1721 (1985) disclose methods for deleting genes in *Aspergillus nidulans* by DNA mediated transformation using a linear fragment of homologous DNA.

Additionally, a requisite amount of one or more EG type components purified by conventional procedures can be added to a cellulase composition produced from a microorganism genetically engineered, so as to be incapable of producing EG type components. so as to achieve a specified ratio of CBH I type components to one or more EG type components, i.e., a cellulase composition free of all EG type components, so as to be enriched in CBH I type components, can be formulated to contain 1 weight percent of an EG type component merely by adding this amount of a purified EG type component to the cellulase composition.

The detergent compositions of this invention employ a surface active agent (i.e., surfactant, including anionic, nonionic and ampholytic surfactants) well known for their use in detergent compositions.

Suitable anionic surfactants for use in the detergent composition of this invention include linear or branched alkylbenzenesulfonates, alkyl or alkenyl ether sulfates having linear or branched alkyl groups or alkenyl groups, alkyl or alkenyl sulfates, olefinsulfonates, alkanesulfonates, and the like. Suitable counter ions for anionic surfactants include alkali metal ions such as sodium and potassium; alkaline earth metal ions, such as calcium and magnesium, ammonium ion, and alkanolamines having 1 to 3 alkanol groups of carbon number 2or 3.

Ampholytic surfactants include quaternary ammonium salt sulfonates, betaine-type ampholytic surfactants, and the like. Such ampholytic surfactants have both the positive and negative charged groups in the same molecule.

Nonionic surfactants generally comprise polyoxyalkylene ethers, as well as higher fatty acid alkanolamides or alkylene oxide adduct thereof, fatty acid glycerine monoesters, and the like.

Suitable surfactants for use in this invention are disclosed in British Patent Application No. 2 094 826 A, the disclosure of which is incorporated herein by reference.

The surfactant is generally employed in the detergent compositions of this invention in an amount from about 1 weight percent to about 95 weight percent of the total detergent composition and, preferably, from about 5 weight percent to about 45 weight percent of the total detergent composition.

In addition to the cellulase components and the surface active agent, the detergent compositions of this invention can additionally contain the following components:

Hydrolase Except Cellulase

Such hydrolases include carboxylate ester hydrolase, thioester hydrolase, phosphate monoester hydrolase, and phosphate diester hydrolase which act on the ester bond; glycoside hydrolase which acts on glycosyl compounds; an enzyme that hydrolyzes N-glycosyl compounds; thioether hydrolase which acts on the ether bond; and α-amino-acyl-peptide hydrolase, peptidyl-amino acid hydrolase, acyl-amino acid hydrolase, dipeptide hydrolase, and peptidyl-peptide hydrolase which act on the peptide bond. Preferable among them are carboxylate ester hydrolase, glycoside hydrolase, and peptidyl-peptide hydrolase. Suitable hydrolases include (1) proteases belonging to petidyl-peptide hydrolase such as pepsin, pepsin B, rennin, trypsin, chymotrypsin A, chymotrypsin B, elastase, enterokinase, cathepsin C, papain, chymopapain, ficin, thrombin, fibrinolysin, renin, subtilisin, aspergillopeptidase A, collagenase, clostridiopeptidase B, kallikrein, gastrisin, cathepsin D., bromelin, keratinase, chymotrypsin C, pepsin C, aspergillopeptidase B, urokinase, carboxypeptidase A and B, and aminopeptidase; (2) glycoside hydrolases (cellulase which is an essential ingredient is excluded from this group) α-amylase, β-amylase, gluco amylase, invertase, lysozyme, pectinase, chitinase, and dextranase. Preferably among them are α-amylase and β-amylase. They function in acid to neutral systems, but one which is obtained from bacteria exhibits high activity in an alkaline system; and (3) carboxylate ester hydrolase including carboxyl esterase, lipase, pectin esterase, and chlorophyllase. Especially effective among them is lipase.

Trade names of commercial products and producers are as follows: "Alkalase", "Esperase", "Savinase", "AMG", "BAN", "Fungamill", "Sweetzyme", "Thermamyl" (Novo Industry, Copenhagen, Denmark); "Maksatase", "High-alkaline protease", "Amylase THC", "Lipase" (Gist Brocades, N.V., Delft, Holland); "Protease B-400", "Protease B-4000", "Protease AP", "Protease AP 2100" (Scheweizerische Ferment A.G., Basel, Switzerland); "CRD Protease" (Monsanto Company, St. Louis, Mo.); "Piocase" (Piopin Corporation, Monticello, Ill.); "Pronase P", "Pronase AS", "Pronase AF" (Kaken Chemical Co., Ltd., Japan); "Lapidase P-2000" (Lapidas, Secran, France); protease products (Tyler standard sieve, 100% pass 16 mesh and 100% on 150 mesh) (Clington Corn Products, Division of Standard Brands Corp., N.Y.); "Takamine", "Bromelain 1:10", "HT Protease 200", "Enzyme L-W" (obtained from fungi, not from bacteria) (Miles Chemical Company, Elkhart, Ind.); "Rhozyme P-11 Conc.", "Pectinol", "Lipase B", "Rhozyme PF", "Rhozyme J-25" (Rohm & Haas, Genencor, South San Francisco, Calif.); "Ambrozyme 200" (Jack Wolf & Co., Ltd., Subsidiary of Nopco Chemical Company, Newark, N.J.); "ATP 40", "ATP 120", "ATP 160" (Lapidas, Secran, France); "Oripase" (Nagase & Co., Ltd., Japan).

The hydrolase other than cellulase is incorporated into the detergent composition as much as required according to the purpose. It should preferably be incorporated in an amount of 0.001 to 5 weight percent, and more preferably 0.02 to 3 weight percent, in terms of purified enzyme. This enzyme should be used in the form of granules made of crude enzyme alone or in combination with other components in the detergent composition. Granules of crude enzyme are used in such an amount that the purified enzyme is 0.001 to 50 weight percent in the granules. The granules are used in an amount of 0.002 to 20 and preferably 0.1 to 10 weight percent.

Cationic Surfactants and Long-Chain Fatty Acid Salts

Such cationic surfactants and long-chain fatty acid salts include saturated or unsaturated fatty acid salts, alkyl or alkenyl ether carboxylic acid salts, α-sulfofatty acid salts or esters, amino acid-type surfactants, phosphate ester surfactants, quaternary ammonium salts including those having 3 to 4 alkyl substituents and up to 1 phenyl substituted alkyl substituents. Suitable cationic surfactants and long-chain fatty acid salts are disclosed in British Patent Application No. 2 094 826 A, the disclosure of which is incorporated herein by reference. The composition may contain from about 1 to about 20 weight percent of such cationic surfactants and long-chain fatty acid salts.

Builders

A. Divalent Sequestering Agents

The composition may contain from about 0 to about 50 weight percent of one or more builder components selected from the group consisting of alkali metal salts and alkanolamine salts of the following compounds: phosphates, phosphonates, phosphonocarboxylates, salts of amino acids, aminopolyacetates high molecular electrolytes, non-dissociating polymers, salts of dicarboxylic acids, and aluminosilicate salts. Suitable divalent sequestering agents are disclosed in British Patent Application No. 2 094 826 A, the disclosure of which is incorporated herein by reference.

B. Alkalis or Inorganic Electrolytes

The composition may contain from about 1 to about 50 weight percent, preferably from about 5 to about 30 weight percent, based on the composition of one or more alkali metal salts of the following compounds as the alkalis or inorganic electrolytes: silicates, carbonates and sulfates as well as organic alkalis such as triethanolamine, diethanolamine, monoethanolamine and trilsopropanolamine.

Antiredeposition Agents

The composition may contain from about 0.1 to about 5 weight percent of one or more of the following compounds as antiredeposition agents: polyethylene glycol, polyvinyl alcohol, polyvinylpyrrolidone and carboxymethylcellulose.

Among them, a combination of carboxymethylcellulose or/and polyethylene glycol with the cellulase composition of the present invention provides for an especially useful dirt removing composition.

For removing the decomposition of carboxymethylcellulose by the cellulase in the detergent, it is desirable that carboxymethylcellulose is granulated or coated before the incorporation in the composition.

Bleaching Agents

The use of the cellulase of the present invention in combination with a bleaching agent such as sodium percarbonate, sodium perborate, sodium sulfate/hydrogen peroxide adduct and sodium chloride/hydrogen peroxide adduct or/and a photo-sensitive bleaching dye such as zinc or aluminum salt of sulfonated phthalocyanine further improves the deterging effects.

Bluing Agents and Fluorescent Dyes

Various bluing agents and fluorescent dyes may be incorporated in the composition, if necessary. Suitable bluing agents and fluorescent dyes are disclosed in British Patent Application No. 2 094 826 A, the disclosure of which is incorporated herein by reference.

Caking Inhibitors

The following caking inhibitors may be incorporated in the powdery detergent: p-toluenesulfonic acid salts, xylenesulfonic acid salts, acetic acid salts, sulfosuccinic acid salts, talc, finely pulverized silica, clay, calcium silicate (such as Micro-Cell of Johns Manville Co.), calcium carbonate and magnesium oxide.

Masking Agents for Factors Inhibiting the Cellulase Activity

The cellulase composition of this invention are deactivated in some cases in the presence of copper, zinc, chromium, mercury, lead, manganese or silver ions or their compounds. Various metal chelating agents and metal-precipitating agents are effective against these inhibitors. They include, for example, divalent metal ion sequestering agents as listed in the above item with reference to optional additives as well as magnesium silicate and magnesium sulfate.

Cellobiose, glucose and gluconolactone act sometimes as the inhibitors. It is preferred to avoid the co-presence of these saccharides with the cellulase as far as possible. In case the co-presence is unavoidable, it is necessary to avoid the direct contact of the saccharides with the cellulase by, for example, coating them.

Long-chain-fatty acid salts and cationic surfactants act as the inhibitors in some cases. However, the co-presence of these substances with the cellulase is allowable if the direct contact of them is prevented by some means such as tableting or coating.

The above-mentioned masking agents and methods may be employed, if necessary, in the present invention.

Cellulase-Activators

The activators vary depending on variety of the cellulases. In the presence of proteins, cobalt and its salts, magnesium and its salts, and calcium and its salts, potassium and its salts, sodium and its salts or monosaccharides such as mannose and xylose, the cellulases are activated and their deterging powers are improved remarkably.

Antioxidants

The antioxidants include, for example, tert-butylhydroxytoluene, 4,4'-butylidenebis(6-tert-butyl-3-methylphenol), 2,2'-butylidenebis(6-tert-butyl-4-methylphenol), monostyrenated cresol, distyrenated cresol, monostyrenated phenol, distyrenated phenol and 1,1-bis(4-hydroxyphenyl)cyclohexane.

Solubilizers

The solubilizers include, for example, lower alcohols such as ethanol, benzenesulfonate salts, lower alkylbenzenesulfonate salts such as p-toluenesulfonate salts, glycols such as propylene glycol, acetylbenzenesulfonate salts, acetamides, pyridinedicarboxylic acid amides, benzoate salts and urea.

The detergent composition of the present invention can be used in a broad pH range of from acidic to alkaline pH.

Aside from the above ingredients, perfumes, preservatives, dyes and the like can be used, if desired, with the detergent compositions of this invention.

When a detergent base used in the present invention is in the form of a powder the cellulase composition is preferably formulated as granules. Preferably, the granules can be formulated so as to contain a cellulase protecting agent. See, for instance, U.S. Ser. No. 07/642,669 filed Jan. 17, 1991, as Attorney Docket No. 010055-073, and entitled "GRANULES CONTAINING BOTH AN ENZYME AND AN ENZYME PROTECTING AGENT AND DETERGENT COMPOSITIONS CONTAINING SUCH GRANULES," which application is incorporated herein by reference in its entirety. Likewise, the granules can be formulated so as to contain materials to reduce the rate of dissolution of the granules into the wash medium. Such materials and granules are disclosed in U.S. Ser. No. 07/642,596 filed on Jan. 17, 1991 as Attorney Docket No. GCS-171-US1 and entitled "GRANULAR COMPOSITIONS" which application is incorporated herein by reference in its entirety. With a highly dense, granular detergent base obtained such as by the spray-drying-granulation method, various ingredients may also be added after the preparation of the base. The granules or other detergent formulations containing the cellulase composition can then be used for cleaning fabrics, imparting softening properties to the fabric and the like.

When the detergent base is a liquid, it may be either a homogeneous solution or an inhomogeneous dispersion.

The following examples are offered to illustrate the present invention and should not be construed in any way as limiting the scope of this invention.

EXAMPLES

Example 1

Fractionation of Cellulase Components

CYTOLASE 123 cellulase, a commercially available cellulase system (from Genencor International, Inc., South San Francisco, Calif.) derived from wild type *Trichodermia longibrachiatum*, was fractionated. The normal distribution of cellulase components in this cellulase system is as follows:

| | |
|---|---|
| CBH I | 45–55 weight percent |
| CBH II | 13–15 weight percent |
| EG I | 11–13 weight percent |
| EG II | 8–10 weight percent |
| EG III | Less than 4 weight percent |
| BG | 0.5–1 weight percent |

The fractionation was done using columns containing the following resins: Sephadex G-25 gel filtration resin from Sigma Chemical Company (St. Louis, Mo.), QA Trisacryl M anion exchange resin and SP Trisacryl M cation exchange resin from IBF Biotechnics (Savage, Md.). CYTOLASE 123 cellulase, 0.5 g, was desalted using a column of 3 liters of Sephadex G-25 gel filtration resin with 10 mM sodium phosphate buffer at pH 6.8. The desalted solution, was then loaded onto a column of 20 ml of QA Trisacryl M anion exchange resin equilibrated with 10 mM sodium phosphate buffer pH=6.8. The fraction bound on this column contained CBH I and EG I. These components were separated by gradient elution using an aqueous gradient containing from 0 to about 500 mM sodium chloride. The fraction not bound on this column contained CBH II, EG II and EG III. These fractions were desalted using a column of Sephadex G-25 gel filtration resin equilibrated with 10 mM sodium citrate, pH 4.5. This solution, 200 ml, was then loaded onto a column of 20 ml of SP Trisacryl M cation exchange resin. CBH II, EG II, and EG III were eluted separately using an aqueous gradient containing from 0 to about 200 mM sodium chloride.

Following procedures similar to that of Example 1 above, other cellulase systems which can be separated into their components include CELLUCAST (available from Novo Industry, Copenhagen, Denmark), RAPIDASE (available from Gist Brocades, N.V., Delft, Holland), and cellulase systems derived from *T. koningii*, Penicillum sp. and the like.

Example 2

Cleanliness Assay of Cellulase Compositions

Certain of the cellulase components isolated above were combined so as to provide for cellulase compositions having known ratios of CBH I components to EG components. These combinations were then employed in the swatch washing procedure set forth below. This procedure tests the ability of different cellulase detergent compositions to clean cotton swatches. In this procedure, the degree of cleaning is measured by the change (increase) in reflectance of the cotton swatches after washing as compared to its reflectance prior to washing. The larger increase in reflectance is indicative of cleaner swatches. Also in this procedure, other than the use of different cellulase compositions, the conditions are identical.

Materials

- 50 ml cap tubes
- 3 inch by 4 inch clay soiled Swatches cut in quarters (depending upon stain, use ¼ size for clay)
- Cellulase sample
- Detergent (commercially available powder or liquid detergents)
- Shakers
- 37° C. room
- 50 mM sodium citrate or 50 mM sodium
- Acetate, pH 4.8–5.0

Procedure

- Gloves are worn when handling swatches in order to avoid introducing any foreign components onto the swatches.
- Calculate ppm cellulase to add to each swatch tube.
- Label swatches, include duplicates and controls.
- Measure reflectance of each swatch.
- Load 1 swatch per tube.
- Piper 25 mls of sodium citrate buffer per tube.
- Piper the calculated ppm cellulase into each tube.
- Cap tubes.
- Shake each tube hard once.

Place tubes on shakers in 37° C. room for 30 minutes.

Prepare a 1:20 dilution of detergent in distilled water.

After 30 minute incubation with cellulase, add 1 ml of the 1:20 dilution of detergent to each tube.

Shake each tube hard once.

Place tubes back on shakers in 37° C. room for 20 minutes.

Prepare a 1:500 dilution of detergent in distilled water.

After incubation, rinse swatches in the tubes one time each with distilled water.

To each tube add 25 mls of the 1:500 dilution of detergent in distilled water.

Shake each tube hard once.

Place tubes back on shakers in 37° C. room for 20 minutes.

After incubation, rinse swatches in the tubes 2–3 times with distilled water. With tube partially filled with distilled water and capped, shake the tube vigorously a few times. Remove swatches from tube and rinse lightly one final time. Place swatch on paper towel and dry.

Measure reflectance of each swatch.

The results of this procedure are set forth in Table I below. This table indicates the increase in reflectance for detergent compositions employing the cellulase compositions having the amounts of EG II component indicated by the x-axis and the amounts of CBH I component indicated by the y-axis.

TABLE I (Values Reported are Reflectance Values)

| ppm | ppm EG II | | | | |
|---|---|---|---|---|---|
| CBH-I | 0 | 10 | 30 | 100 | 500 |
| 0 | 7.75 | 15.9 | 15.95 | 19.16 | 20.45 |
| 20 | 7.5 | 27.25 | 26.45 | 31.06 | — |
| 50 | 11.95 | 33.4 | 30.65 | 30.9 | — |
| 100 | 11.85 | 37.4 | 38.15 | 39.55 | — |
| 200 | 16.4 | 51.1 | 52.8 | 49.5 | — |
| 500 | 19.25 | 56.85 | 54.4 | 62.6 | — |

The above data demonstrate that ratios of CBH I component to EG II component greater than 5:1 provide excellent cleaning of the cotton swatches at a level almost as good as ratios of CBH I component to EG II component of 5:1 or less. In fact, a 50:1 ratio of CBH I component to EG II component provides about 91 percent of the cleaning ability of a 5:1 ratio of these two cellulase components. Moreover, because the amount of EG components (in the presence of CBH components) are reduced relative to the cellulase system, the degradation potential of the detergent composition containing this cellulase composition is reduced relative to detergent compositions containing cellulase compositions having greater amounts of EG components.

In comparison to the results set forth in Table I above, Table II below sets forth the increase in reflectance resulting from the use of a cellulase system derived from *Trichoderma longibrachiatum* in the procedure set forth above. As noted in Example 1 above, such cellulase has an approximate ratio of 2.5:1 of CBH I component to EG components (i.e., EG I, EG II and EG III).

TABLE II

| | ppm cellulase | | | | | |
|---|---|---|---|---|---|---|
| | 0 | 50 | 100 | 200 | 500 | 1000 |
| reflt.[a] | 17.75 | 52.05 | 61.55 | 63.9 | 66.15 | 70.55 |

[a] = reflt. means reflectance values.

The above data shows that the detergent compositions of this invention provide excellent cleaning of cotton swatches at a level almost on par with detergent compositions containing a cellulase system. For example, the reflectance resulting from using 500 ppm CBH I component and 10 ppm EG II component in the above procedure was 56.85 (Table I) or about 86 percent of the reflectance resulting from using 500 ppm of the cellulase system. This data further shows that excellent cleaning can be obtained in spite of the fact that a sizeable portion of the EG components have been removed from the composition.

Example 3

Cleanliness Assay of Cellulase Compositions

Certain of the cellulase components isolated above were combined so as to provide for cellulase compositions having known ratios of CBH I component to EG components. These combinations were then employed in the swatch washing procedure set forth in Example 2 above. As in Example 2 above, other than the use of different cellulase compositions, the conditions are identical.

The results of this procedure are set forth in Table III below. This table indicates the increase in reflectance for cellulase compositions used in this procedure and which have the amounts of EG I and EG II components (comprised of equal amounts of EG I and EG II components) indicated by the x-axis and the amounts of CBH I component indicated by the y-axis. The CBH I composition may contain approximately 1% of EG component impurities, but the amount of EG component has been indicated as O. The indicated amounts of EG I and EG II should be added to this background contamination of EG components.

TABLE III (Values Reported are Reflectance Values)[b]

| ppm | ppm EG I plus EG II[c] | | | | | | | |
|---|---|---|---|---|---|---|---|---|
| CBH I | 0 | 5 | 10 | 20 | 40 | 100 | 200 | 400 |
| 0 | 25 | — | — | — | — | — | — | — |
| 10 | — | — | 17.5 | 14.7 | 20.2 | 17.3 | — | — |
| 20 | — | — | 28.4 | 25.7 | 31.1 | 30.1 | 30 | 32.75 |
| 50 | — | — | 55.4 | 56.7 | 55.7 | 50.5 | 62 | — |
| 100 | — | — | 63.3 | 68.3 | 60.1 | 51.2 | — | — |
| 200 | — | 58.1[d] 42 | 60.8 | 61.7 | 61.1 | 57.4 | — | — |
| 500 | 36.4[e] | — | 62.1 | 66.1 | 66 | 63.5 | — | — |
| 1000 | 44.8[e] | — | — | — | — | — | — | — |

[b] = all reflectance values are the average of two duplicate runs; certain of the reflectance values reported herein have been rounded to the nearest tenth.
[c] = 500 ppm EG I and EG II without CBH I gave a reflectance value of 17.
[d] = the duplicate runs for this combination of CBH I component and EG components varied so substantially that both results are reported herein.
[e] = these cleaning results are possibly due to EG component impurities in the CBH I component of approximately 1 weight percent or less.

The above data together with the data taken from Example 2 demonstrates that ratios of CBH I component to EG components greater than 5:1 provide excellent cleaning of the cotton swatches at a level on par with ratios of CBH I components to EG components of 5:1 or less. For example, in Table III, a 10:1 ratio of CBH I component to EG components, i.e., 100 ppm CBH I to 10 ppm EG I plus EG II, provides about 92 percent of the cleaning ability of a 5:1 ratio of these two cellulase components, i.e., 100 ppm CBH I to 20 ppm EG I plus EG II. Likewise, a 25:1 ratio of CBH I component to EG component, i.e., 500 ppm CBH I to 20 ppm EG I plus EG II, provides substantially the same level of cleaning as a 5:1 ratio of these two cellulase components i.e., 500 ppm CBH I to 100 ppm EG I plus EG II. Moreover, because the amount of EG components are reduced (in the presence of CBH components) relative to the cellulase system, the degradation potential of the detergent composition containing this cellulase composition is reduced relative to detergent compositions containing cellulase compositions having greater amounts of EG components.

In comparison to the results set forth in Table III above, Table IV below sets forth the increase in reflectance resulting from the use of a cellulase system derived from *Trichodermia longibrachiatum* in the procedure set forth above. As noted in Example I above, such cellulase has an approximate ratio of 2.5:1 of CBH I component to EG components, i.e., EG I, EG II and EG III.

TABLE IV

| | ppm cellulase | | |
|---|---|---|---|
| | 20 | 50 | 100 |
| reflectance values | 32.5 | 42.2 | 57.7 |

The above data shows that the detergent compositions of this invention (e.g., containing an enriched fraction of CBH I type cellulase component relative to the EG components) are capable of providing a level of cleaning on par with a cellulase system in spite of the fact that a sizeable portion of the EG components have been removed from the composition.

Similarly, a CBH I type cellulase component and EG components could be substituted in place of CBH I component and EG I and II components employed in Examples II and III to provide a degradation resistant detergent composition having excellent cleaning. Such CBH I type cellulase components can be obtained from *T. koningii*, Penicillium sp. and the like.

Example 4

Softness Assay of Cellulase Compositions

Certain cellulase compositions were produced by genetically modifying the *T. longibrachiatum* microorganism so as to be incapable of producing one or more EG-type components which methods do not produce any heterologous protein. The method used to produce the cellulase compositions is disclosed in Examples 6–11 and U.S. Ser. No. 07/770,049 filed Oct. 4, 1991, which is a continuation-in-part of U.S. Ser. No. 07/593,919 filed Oct. 5, 1990, both of which are incorporated herein by reference in their entirety. These combinations were then employed in the swatch washing procedure set forth below. This procedure tests the ability of different cellulase detergent compositions to soften cotton swatches. In this procedure, the degree of softness is measured by whole fabric feel by a group of panelists.

The washing machine (Unimac 50 lb. capacity, rotary drum) was filled with 9.5 gallons of cold water. The buffer (42 grams of citric acid anhydrous and 101 grams of sodium phosphate dibasic) and 50 mls Triton™ X-114 were added to the washing machine. The temperature of the wash liquor was adjusted to 40° C. and the test cellulase composition added. Specifically, an appropriate amount to provide for 2000 ppm, 1000 ppm, 500 ppm, 250 ppm and 100 ppm of certain cellulase compositions was added in the final detergent wash. If required, the pH was then adjusted to pH 5.0 by adding citric acid or sodium phosphate. Three 100% cotton terry towels, 25"×46", were washed for 45 minutes at 37 rpm at 60°–80° C. and then dried for 2 minutes at a maximum rpm of 460. The towels were rinsed in 24 gallons of water at 34° C. for 5 minutes. The towels were again dried for 2 minutes at a maximum rpm of 460. The towels were dried in a conventional drier for 50 minutes on the high temperature setting of approximately 60°–80° C.

After washing, the towels were then labeled (to prevent panelists from ascertaining how the fabric had been treated) and tested for softness by a group of panelists by whole fabric feel and by mechanized test methods. The panelists evaluated the fabrics by a preference for "softer" and "rougher" fabric.

The first set of fabrics analyzed was treated with an EG I and EG II deleted cellulase composition prepared from *Trichoderma longibrachiatum* genetically modified in a manner similar to that described below, so as to be incapable of expressing EG I and EG II. Insofar as EG I and EG II comprises up to about 23 percent of the cellulase composition, deletion of this component results in enriched levels of all of the CBH components. Moreover, because EG components, other than EG I and II, comprise no more than about 5 weight percent of the complete cellulase composition, the CBH I to EG ratio in the EG I/II deleted cellulase composition was at least about 12:1.

The second set of fabrics analyzed were tested with a control solution which did not contain a cellulase composition.

The test fabrics were judged for softness by six panelists, in two different tests, on the basis of whole fabric feel. The results of this test demonstrated that at least 250 ppm of an EG I/EG II deleted cellulase composition provides softening of the cotton fabric as compared to the control solution which did not contain a cellulase composition. This data shows that enhanced softening as compared to the control can be obtained even though a sizeable portion of the EG components have been removed from the cellulase composition. Therefore, a cellulase composition comprising CBH I and EG components in a ratio of at least 5:1 will provide some softening.

The test fabrics were further judged for softness by another 8 panelists, also on the basis of whole fabric feel. It was found that while 100 ppm of EG I/EG II deleted cellulase composition did not significantly soften the cotton fabric in a single treatment over that of the control, increasing the amount of EG I/EG II deleted cellulase in the treatment of the cotton fabric resulted in increased softening over the control. It is also contemplated that repeated treatments at these lower concentrations will also result in enhanced softening.

The fabrics treated with the cellulase compositions were also tested for stiffness of fabric by the cantilever test method as described in *American Standard Test Manual Methods*, Designation D 1388–64 (Reapproved 1975), which is incorporated herein by reference in its entirety. In summary, a strip of fabric is slid in a direction parallel to its long dimension so that its end projects from the edge of a horizontal surface. The length of overhang is measured when the tip of the test specimen is depressed under its own weight to the point where the line joining the tip to the edge of the platform makes an angle of 41.5° with the horizontal. One half of this length is the bending length of the specimen. The cube of this quantity multiplied by the weight per unit area of the fabric is the flexural rigidity.

The results of this procedure demonstrated that cotton fabric treated with the EG I/II deleted cellulase composition overall had reduced flexural rigidity when compared to cotton fabric treated with the control solution which did not contain a cellulase composition. These results indicate that the flexural rigidity of the fabric is decreased and thus softness is increased in fabric treated with a cellulase composition comprising at least a 10:1 ratio of CBH I to EG components over the control.

Example 5

Tensile Testing of Cotton Fabric treated with Cellulase

Cotton terry towels were treated with cellulase compositions by the method described in Example 4 except a set of fabrics treated with whole cellulase was included in the analysis. Specifically, the composition analyzed was a complete fungal cellulase composition (CYTOLASE 123 cellulase, commercially available from Genencor International, Inc., South San Francisco, Calif.) produced by wild-type *Trichoderma longibrachiatum.*

The test fabrics were tested for breaking load and elongation of the fabric by the test method as described in *American Standard Test Manual Methods*, Designation D 1682–64 (Reapproved 1975) which is incorporated herein by reference in its entirety. In summary, a specimen of fabric is cut to the width to be tested, a continually increasing load is applied longitudinally to the specimen, and the test is carried to rupture in a specific time. Values for the breaking load and elongation of the test specimen are obtained from machine scales or dials or autographic recording charts.

The results of this procedure demonstrated that cotton fabric treated with the same total weight of the EG I/II deleted cellulase composition had reduced strength loss compared to fabrics treated with the same total weight of the complete cellulase composition. Contrarily, as expected both cellulase compositions showed increased strength loss as compared to the control. Therefore, treatment of fabric with a cellulase composition comprising at least a 10:1 ratio of CBH I to EG components will result in cleaning and some softening of the fabric with reduced strength loss.

Example 6

Selection for pyr4.Derivatives of *Trichoderma longibrachiatum*

The pyr4 gene encodes orotidine-5'-monophosphate decarboxylase, an enzyme required for the biosynthesis of uridine. The toxic inhibitor 5-fluoroorotic acid (FOA) is incorporated into uridine by wild-type cells and, thus, poisons the cells. However, cells defective in the pyr4 gene are resistant to this inhibitor but require uridine for growth. It is, therefore, possible to select for pyr-4 derivative strains using FOA. In practice, spores of *T. longibrachiatum* strain RL-P37 (Sheir-Neiss, G. and Montenecourt, B. S., *Appl. Microbiol. Biotechnol.*, 20, p. 46–53 (1984)) were spread on the surface of a solidified medium containing 2 mg/ml uridine and 1.2 mg/ml FOA. Spontaneous FOA-resistant colonies appeared within three to four days and it was possible to subsequently identify those FOA-resistant derivatives which required uridine for growth. In order to identify those derivatives which specifically had a defective pyr4 gene, protoplasts were generated and transformed with a plasmid containing a wild-type pyr4 gene (see Examples 8 and 9). Following transformation, protoplasts were plated on medium lacking uridine. Subsequent growth of transformed colonies demonstrated complementation of a defective pyr4 gene by the plasmid-borne pyr4 gene. In this way, strain GC69 was identified as a pyr4$^-$ derivative of strain RL-P37.

Example 7

Preparation of CBHI Deletion Vector

A cbh1 gene encoding the CBHI protein was cloned from the genomic DNA of *T. longibrachiatum* strain RL-P37 by hybridization with an oligonucleotide probe designed on the basis of the published sequence for this gene using known probe synthesis methods (Shoemaker et al., 1983b). The cbh1 gene resides on a 6.5 kb PstI fragment and was inserted into PstI cut pUC4K (purchased from Pharmacia Inc., Piscataway, N.J.) replacing the Kan$^r$ gene of this vector using techniques known in the art, which techniques are set forth in Maniatis et al. (1989) and incorporated herein by reference. The resulting plasmid, pUC4K::cbh1 was then cut with HindIII and the larger fragment of about 6 kb was isolated and relegated to give pUC4K::cbh1ΔH/H (see FIG. 1). This procedure removes the entire cbh1 coding sequence and approximately 1.2 kb upstream and 1.5 kb downstream of flanking sequences. Approximately, 1 kb of flanking DNA from either end of the original PstI fragment remains.

The *T. longibrachiatum* pyr4 gene was cloned as a 6.5 kb HindIII fragment of genomic DNA in pUC18 to form pTpyr2 (Smith et al., 1991) following the methods of Maniatis et al., *Molecular Cloning: A Laboratory Manual*, Cold Spring Harbour (1989). The plasmid pUC4K::cbhΔH/H was cut with HindIII and the ends were dephosphorylated with calf intestinal alkaline phosphatase. This end dephosphorylated DNA was ligated with the 6.5 kb HindIII fragment containing the *T. longibrachiatum pyr*4 gene to give pΔCBHIpyr4. FIG. 1 illustrates the construction of this plasmid.

Example 8

Isolation of Protoplasts

Mycelium was obtained by inoculating 100 ml of YEG (0.5% yeast extract, 2% glucose) in a 500 ml flask with about $5\times10^7$ *T. longibrachiatum* GC69 spores (the pyr4.derivative strain). The flask was then incubated at 37° C. with shaking for about 16 hours. The mycelium was harvested by centrifugation at 2,750×g. The harvested mycelium was further washed in a 1.2M sorbitol solution and resuspended in 40 ml of a solution containing 5 mg/ml Novozym® 234 solution (which is the trade name for a multicomponent enzyme system containing 1,3-alpha-glucanase, 1,3-beta-glucanase, laminarinase, xylanase, chitinase and protease from Novo Biolabs, Danbury, Conn.); 5 mg/ml $MgSO_4.7H_2O$;0.5 mg/ml bovine serum albumin; 1.2M sorbitol. The protoplasts were removed from the cellular debris by filtration through Miracloth (Calbiochem Corp, La Jolla, Calif.) and collected by centrifugation at 2,000×g. The protoplasts were washed three times in 1.2M sorbitol and once in 1.2M sorbitol, 50 mM $CaCl_2$, centrifuged and resuspended at a density of approximately $2\times10^8$ protoplasts per ml of 1.2M sorbitol, 50 mM $CaCl_2$.

Example 9

Transformation of Fungal Protoplasts with pΔCBHIpyr4

200 μl of the protoplast suspension prepared in Example 8 was added to 20 μl of EcoRI digested pΔCBHIpyr4 (prepared in Example 7) in TE buffer (10 mM Tris, pH 7.4; 1 mM EDTA) and 50 μl of a polyethylene glycol (PEG) solution containing 25% PEG 4000, 0.6M KCl and 50 mM $CaCl_2$. This mixture was incubated on ice for 20 minutes. After this incubation period 2.0 ml of the above-identified PEG solution was added thereto, the solution was further mixed and incubated at room temperature for 5 minutes. After this second incubation, 4.0 ml of a solution containing 1.2M sorbitol and 50 mM $CaCl_2$ was added thereto and this solution was further mixed. The protoplast solution was then immediately added to molten aliquots of Vogel's Medium N (3 grams sodium citrate, 5 grams $KH_2PO_4$, 2 grams $NH_4NO_3$, 0.2 grams $MgSO_4.7H_2O$, 0.1 gram $CaCl_2.2H_2O$, 5 μg α-biotin, 5 mg citric acid, 5 mg $ZnSO_4.7\ H_2O$, 1 mg $Fe(NH_4)_2.6H_2O$, 0.25 mg $CuSO_4.5H_2O$, 50 μg MnSO4.4H20 per liter) containing an additional 1% glucose, 1.2M sorbitol and 1% agarose. The protoplast/medium mixture was then poured onto a solid medium containing the same Vogel's medium as stated above. No uridine was present in the medium and therefore only transformed colonies were able to grow as a result of complementation of the pyr4 mutation of strain GC69 by the wild type pyr4 gene insert in pΔCBHIpyr4. These colonies were subsequently transferred and purified on a solid Vogel's medium N containing as an additive, 1% glucose and stable transformants were chosen for further analysis.

At this stage stable transformants were distinguished from unstable transformants by their faster growth rate and formation of circular colonies with a smooth, rather than ragged outline on solid culture medium lacking uridine. In some cases a further test of stability was made by growing the transformants on solid non-selective medium (i.e. containing uridine), harvesting spores from this medium and determining the percentage of these spores which will subsequently germinate and grow on selective medium lacking uridine.

Example 10

Construction of PΔEGIpyr-3 and Transformatin of a pyr4 Deficient Strain of *T. Longibrachiatum*

The *T. longibrachiatum* egl1 gene, which encodes EGI has been cloned as a 4.2 kb HindIII fragment of genomic DNA from strain RL-P37 by hybridization with oligonucleotides synthesized according to the published sequence (Pentilla et al., 1986, Gene, 45:253–263; van Arsdell et al., 1987, *Bio/technology,* 5:60–64).

Figure 2:
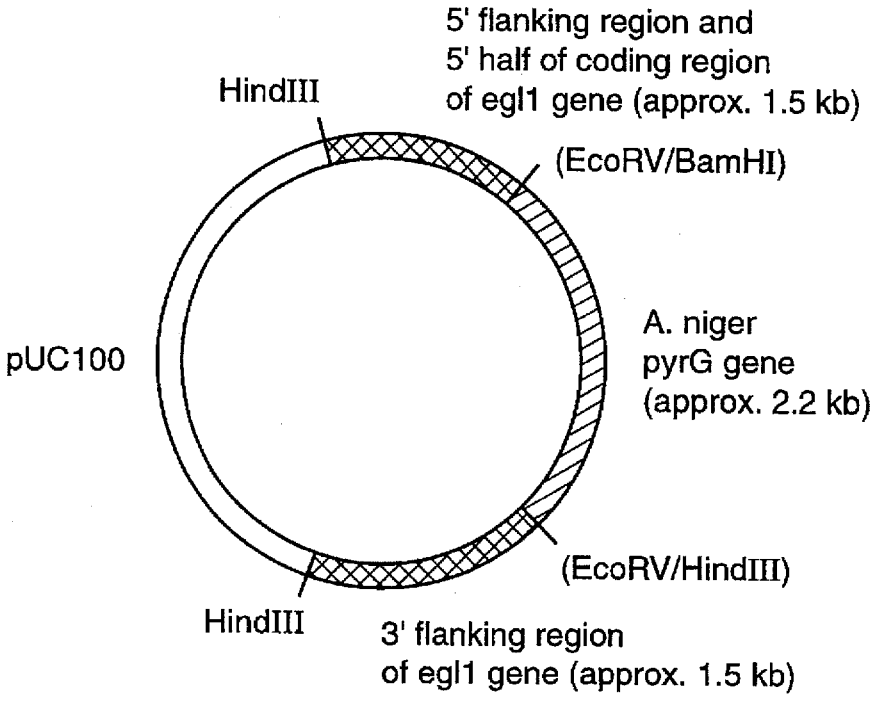
FIG. 2 is an outline of the construction of pΔEGIpyrG-3.
Figure 3:
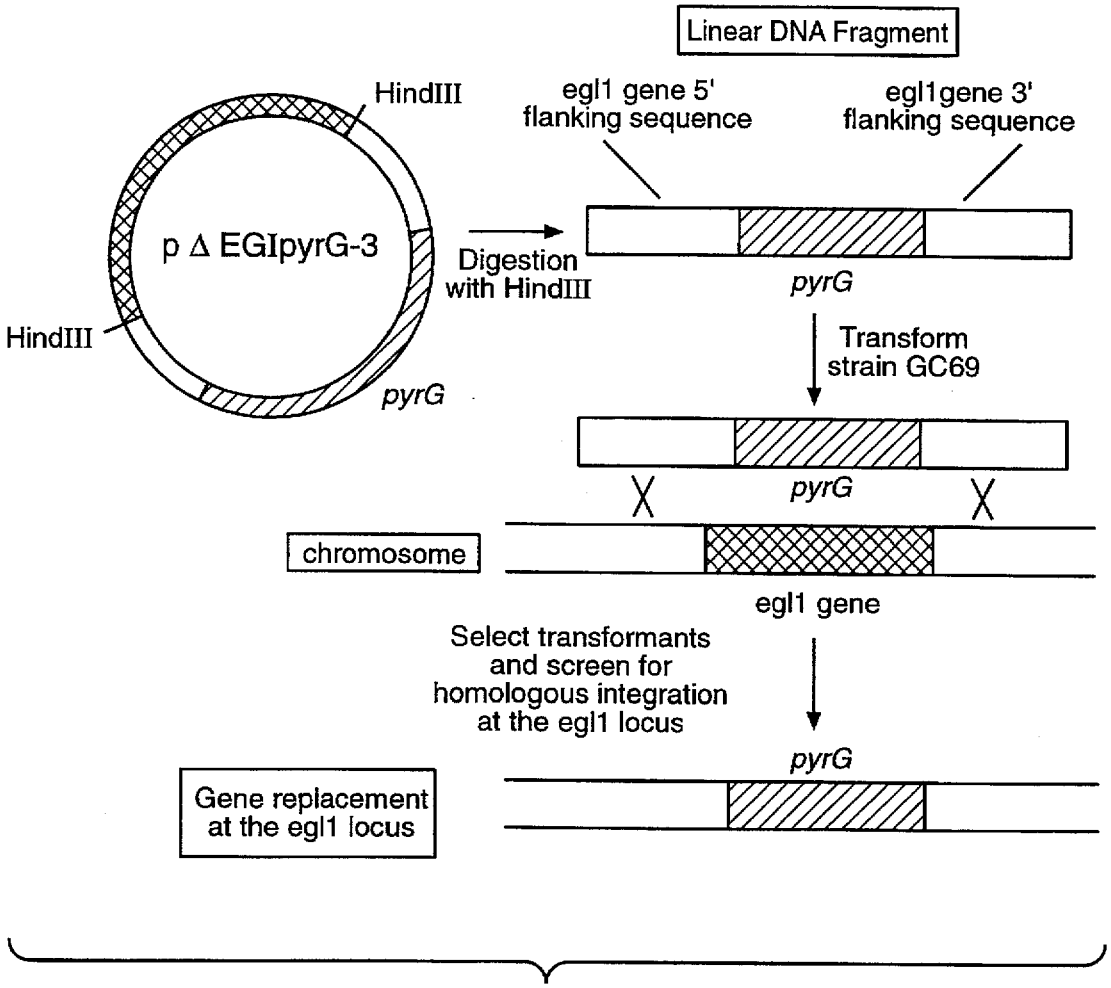
FIG. 3 illustrates deletion of the egl1 gene by integration of the HindIII fragment from pΔEGIpyrG-3 at the egl1 locus on one of the *T. longibrachiatum* chromosomes.

This DNA fragment was inserted at the HindIII site of pUC100. An internal1 kb EcoRV fragment which extended from a position close to the middle of the EGI coding sequence to a position beyond the 3' end of the coding sequence was removed by enzyme digestion and was replaced by ligation with a 2.2 kb BamHI - HindIll fragment containing the cloned *A. niger* pyrG gene (Wilson et al., 1988, *Nucl. Acids Res.,* 16, p. 2339) to give pΔEGIpyrG-3 (FIG. 2). Transformation of a pyr4 deficient strain of *T. longibrachiatum* (strain GC69) by the method set forth in Examples 8 and 9, with pΔEGIpyr-3, after it had been digested with HindIII to release the fragment containing the pyrG gene with flanking regions from the egl1 locus at either end, led to transformants in which the genomic egl1 gene was disrupted by a mechanism outlined in FIG. 3. DNA was extracted from transformants, digested with HindIII, subjected to agarose gel electrophoresis and blotted onto a membrane filter. The filter was hybridized with radiolabelled pΔEGIpyr-3. In the untransformed strain of *T. longibrachiatum* the egl1 gene was present on a 4.2 kb HindIII fragment of DNA. However, following deletion of the egl1 gene by integration of the desired fragment from pΔEGIpyr-3 this 4.2 kb HindIII fragment disappeared and was replaced by a HindIII fragment approximately 1.2 kb larger in size. This pattern was observed for one transformant which was designated ΔEGI-3.

Example 11

Construction of PAΔEGII-1 and Deletion of the EG II Gene

Figure 4:
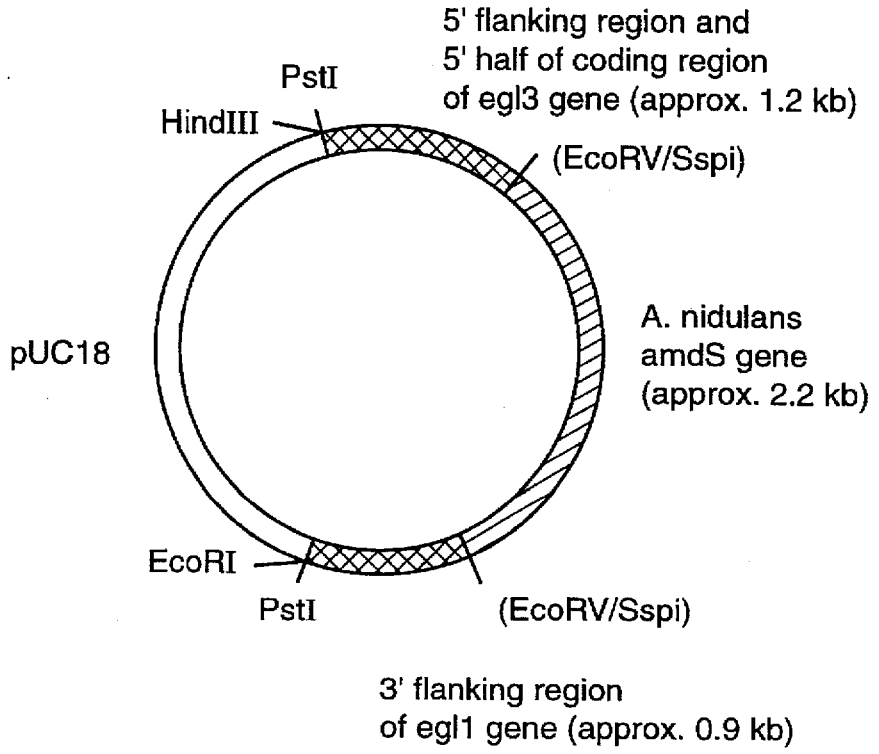
FIG. 4 is an outline of the construction of pAΔEGII-1.

The egl3 gene, encoding EG II (also referred to in the literature as EG III), was cloned from *T. longibrachiatum* strain RL-P37 as a 4 kb Pstl genomic DNA fragment by hybridization with oligonucleotides synthesized according to the published sequence (Saloheimo et al., 1988, *Gene,* 63:11–21). This DNA fragment was inserted into the Pstl site of pUC18. This plasmid, pEGII, was subsequently digested with EcoRV to remove the entire EG II coding region on an approximately 2 kb segment extending from a position approximately 180 bp 5' of the EGII coding region to a position a few hundred base pairs beyond the end of the coding region. This segment was replaced with an Sspl fragment of *Aspergillus nidulans* genomic DNA containing the amdS gene (Corrick et al., 1987, *Gene,* 53:63–71) to create plasmid PAΔEGII-1 (See FIG. 4).

Wild-type strains of *T. longibrachiatum* are unable to grow on acetamide as a sole nitrogen source. Transformation with the amdS gene confers this ability and this is the basis for the selection system for transformants containing this gene.

Protoplasts of strain ΔEGI-3 were transformed, by the methods described in Examples 8 and 9, with pAΔEGII-1 which had been digested with HindIII and EcoRI and transformants able to grow on acetamide were selected. Subsequently, DNA was extracted from stable transformants, digested with Pstl, subjected to agarose gel electrophoresis and blotted onto a membrane filter. The filter was hybridized with radiolabelled pΔAEGII-1. Homologous integration of the HindIII-EcoRI fragment from pΔAEGII-1, which contained egl3 flanking regions and amdS, at the genomic egl3 locus in a transformant lead to the 4 kb genomic Pstl fragment containing the egl3 gene being replaced by smaller Pst1 fragments including two which would be approximately 1.0 and 2.8 kb in length. This pattern of hybridization was observed for one transformant which was designated strain ΔΔEG-1. This strain has deletions in both the EGI and EGII encoding genes and consequently is unable to produce either of these proteins.

The methods described in Examples 6 to 11 and in U.S. Ser. No. 07/770,049, filed Oct. 4, 1991 (incorporated herein by reference in its entirety) may be used to obtain *T. longibrachiatum* transformants which are unable to produce any or all of the following cellulase components; EG I, EG II, EG III and CBH II components.

For the sake of completion, the procedures set forth in Examples 6–11 of U.S. Ser. No. 07/770,049 are repeated as Examples 12–17 below.

Example 12

Analysis of the Transformants

Figure 5:
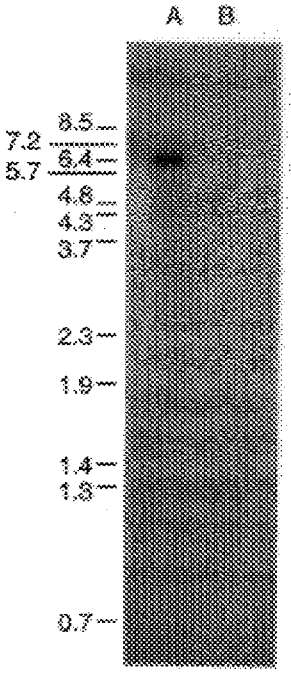
FIG. 5 is an autoradiograph of DNA from a *T. longibrachiatum* strain GC69 transformed with EcoRI digested pΔCBHIpyr4 using a $^{32}$P labelled pIntCBHI as the probe. The sizes of molecular weight markers are shown in kilobase pairs to the left of the Figure.

DNA was isolated from the transformants obtained in Example 9 after they were grown in liquid Vogel's medium N containing 1% glucose. These transformant DNA samples were further cut with a PstI restriction enzyme and subjected to agarose gel electrophoresis. The gel was then blotted onto a Nytran membrane filter and hybridized with a $^{32}$p labelled pIntCBHI probe. This probe is a pUC-type plasmid containing a 2 kb BglII fragment from the cbh1 locus within the region that was deleted in pUC4K::cbh1ΔH/H. Two samples were run in this example including a control, sample A, which is the untransformed strain GC69 and the transformant P37PΔCBHI, sample B. As can be seen in FIG. 5, sample A contained the cbh1 gene, as indicated by the band at 6.5 kb; however the transformant, sample B, does not contain this 6.5 kb band and therefore does not contain the cbh1 gene and does not contain any sequences derived from the pUC plasmid.

Example 13

Protein Secretion by Strain P37PΔCBHI

Figure 6:
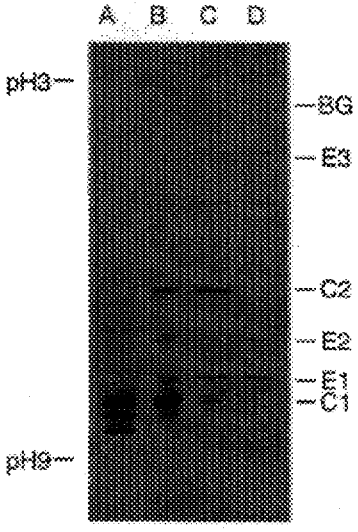
FIG. 6 is an isoelectric focusing gel displaying the proteins secreted by the wild type and by transformed strains of *T. longibrachiatum*. Specifically, in FIG. 6, Lane A of the isoelectric focusing gel employs partially purified CBHI from *T. longibrachiatum*; Lane B employs a wild type *T. longibrachiatum*; Lane C employs protein from a *T. longibrachiatum* strain with the cbh1 gene deleted; and Lane D employs protein from a *T. longibrachiatum* strain with the cbh1 and cbh2 genes deleted.

Spores from the produced P37PΔCBHI strain were inoculated into 50 ml of a Trichoderma basal medium containing 1% glucose, 0.14% $(NH_4)_2SO_4$, 0.2% $KH_2PO_4$, 0.03% $MgSO_4$, 0.03% urea, 0.75% bactotryptone, 0.05% Tween 80, 0.000016% $CuSO_4.5H_2O$, 0.001% $FeSO_4.7H_2O$, 0.000128% $ZnSO_4.7H_2O$, 0.0000054% $Na_2MoO_4.2H_2O$, 0.0000007% MnCl.4H2O). The medium was incubated with shaking in a 250 ml flask at 37° C. for about 48 hours. The resulting mycelium was collected by filtering through Miracloth (Calbiochem Corp.) and washed two or three times with 17 mM potassium phosphate. The mycelium was finally suspended in 17 mM potassium phosphate with 1 mM sophorose and further incubated for 24 hours at 30° C. with shaking. The supernatant was then collected from these cultures and the mycelium was discarded. Samples of the culture supernatant were analyzed by isoelectric focusing using a Pharmacia Phastgel system and pH 3–9 precast gels according to the manufacturer's instructions. The gel was stained with silver stain to visualize the protein bands. The band corresponding to the cbh1 protein was absent from the sample derived from the strain P37PΔCBHI, as shown in FIG. 6. This isoelectric focusing gel shows various proteins in different supernatant cultures of *T. longibrachiatum*. Lane A is partially purified CBHI; Lane B is the supernatant from an untransformed *T. longibrachiatum* culture; Lane C is the supernatant from strain P37PΔCBHI produced according to the methods of the present invention. The position of various cellulase components are labelled CBHI, CBHII, EGI, EGII, and EGIII. Since CBHI constitutes 50% of the total extracellular protein, it is the major secreted protein and hence is the darkest band on the gel. This isoelectric focusing gel clearly shows depletion of the CBHI protein in the P37PΔCBHI strain.

Example 14

Preparation of pPΔCBHII

Figure 7A:
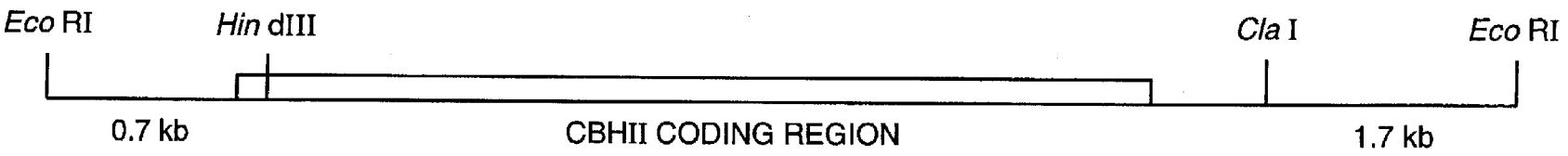
FIG. 7A is a representation of the *T. longibrachiatum* cbh2 locus, cloned as a 4.1 kb EcoRI fragment on genomic DNA
Figure 7B:
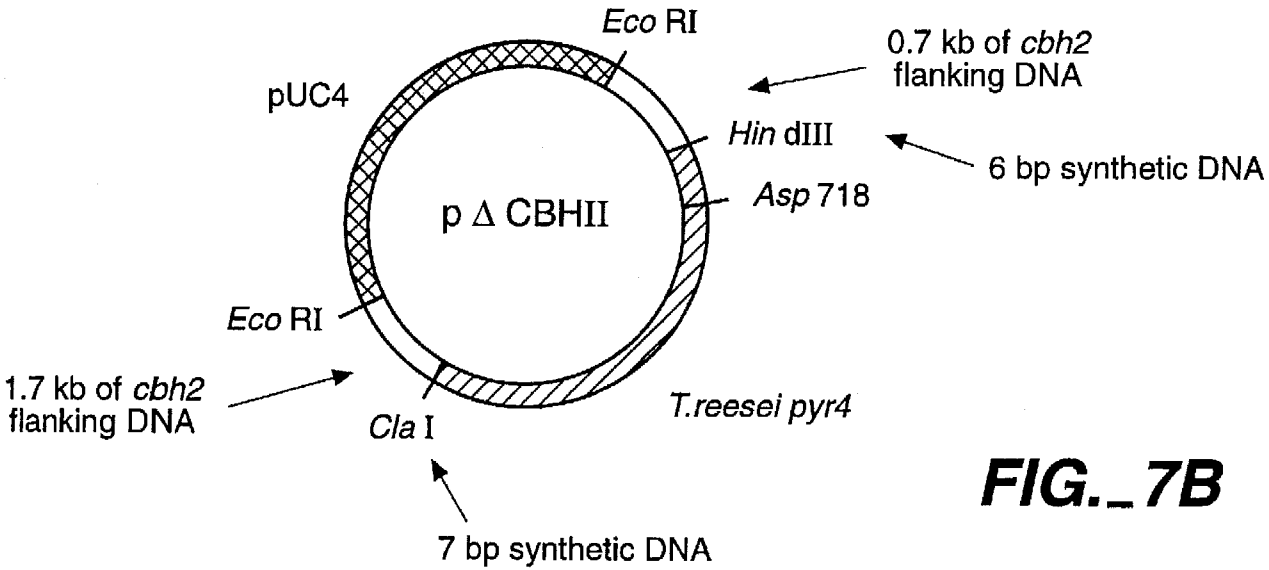
FIG. 7B is a representation of the cbh2 gene deletion vector pPΔCBHII.

The cbh2 gene of *T. longibrachiatum*, encoding the CBHII protein, has been cloned as a 4.1 kb EcoRI fragment of genomic DNA which is shown diagramatically in FIG. 7A (Chen et al., 1987, *Biotechnolgy*, 5:274–278). This 4.1 kb fragment was inserted between the EcoRI sites of pUC4XL. The latter plasmid is a pUC derivative (constructed by R. M. Berka, Genencor International Inc.) which contains a multiple cloning site with a symetrical pattern of restriction endonuclease sites arranged in the order shown here: EcoRI, BamHI, SacI, SmaI, HindIII, XhoI, BglII, ClaI, BglII, XhoI, HindIII, SmaI, SacI, BamHI, EcoRI. Using methods known in the art, a plasmid, pPΔCBHII (FIG. 7B), has been constructed in which a 1.7 kb central region of this gene between a HindIII site (at 74 bp 3' of the CBHII translation initiation site) and a ClaI site (at 265 bp 3' of the last codon of CBHII) has been removed and replaced by a 1.6 kb HindIII-ClaI DNA fragment containing the *T. longibrachiatum* pyr4 gene.

The *T. longibrachiatum pyr*4 gene was excised from pTpyr2 (see Example 7) on a 1.6 kb NheI-SphI fragment and inserted between the SphI and XbaI sites of pUC219 to create p219M (Smith et al., 1991, *Curr. Genet* 19 p. 27–33). The pyr4 gene was then removed as a HindIII-ClaI fragment having seven bp of DNA at one end and six bp of DNA at the other end derived from the pUC219 multiple cloning site and inserted into the HindIII and ClaI sites of the cbh2 gene to form the plasmid pPΔCBHII (see FIG. 7B).

Digestion of this plasmid with EcoRI will liberate a fragment having 0.7 kb of flanking DNA from the cbh2 locus at one end, 1.7 kb of flanking DNA from the cbh2 locus at the other end and the *T. longibrachiatum* pyr4 gene in the middle.

Example 15

Deletion of the cbh2 gene in *T. longibrachiatum* strain GC69

Protoplasts of strain GC69 will be generated and transformed with EcoRI digested pPΔCBHII according to the methods outlined in Examples 8 and 9. DNA from the transformants will be digested with EcoRI and Asp718, and subjected to agarose gel electrophoresis. The DNA from the gel will be blotted to a membrane filter and hybridized with $^{32}$P labelled pPΔCBHII according to the methods in Example 17. Transformants will be identified which have a single copy of the EcoRI fragment from pPΔCBHII integrated precisely at the cbh2 locus. The transformants will also be grown in shaker flasks as in Example 7 and the protein in the culture supernatants examined by isoelectric focusing. In this manner *T. longibrachiatum* GC69 transformants which do not produce the CBHII protein will be generated.

Example 16

Generation of a pyr4$^{31}$ Derivative of P37PΔCBHI

Spores of the transformant (P37PΔCBHI) which was deleted for the cbh1 gene were spread onto medium containing FOA. A pyr4$^{31}$ derivative of this transformant was subsequently obtained using the methods of Example 6. This pyr4$^{31}$ strain was designated P37PΔCBHIPyr$^{31}$26.

Example 17

Deletion of the cbh2 gene in a strain previously deleted for cbh1

Protoplasts of strain P37PΔCBHIPyr$^{31}$26 were generated and transformed with EcoRI digested pPΔCBHII according to the methods outlined in Examples 8 and 9.

Purified stable transformants were cultured in shaker flasks containing 50 ml of a Trichoderma basal medium containing 1% glucose, 0.14% $(N_4)_2SO_4$, 0.2% $KH_2PO_4$, 0.03% $MgSO_4$, 0.03% urea, 0.75% bactotryptone, 0.05% Tween 80, 0.000016% $CuSO_4 \cdot 5H_2O$, 0.001% $FeSO_4.7H_2O$, 0.000128% $ZnSO_4.7H_2O$, 0.0000054% $Na_2MoO_4.2H_2O$, 0.0000007% MnCl.4H2O). The medium was incubated with shaking in a 250 ml flask at 37° C. for about 48 hours. The resulting mycelium was collected by filtering through Miracloth (Calbiochem Corp.) and washed two or three times with 17 mM potassium phosphate. The mycelium was finally suspended in 17 mM potassium phosphate with 1 mM sophorose and further incubated for 24 hours at 30° C. with shaking. The supernatant was then collected from these cultures and the mycelium was discarded. The protein in the culture supernatants was examined by isoelectric focusing. One transformant (designated P37PΔΔCBH67) was identified which did not produce any CBHII protein. Lane D of FIG. 6 shows the supernatant from a transformant deleted for both the cbh1 and cbh2 genes produced according to the methods of the present invention.

Figure 8:
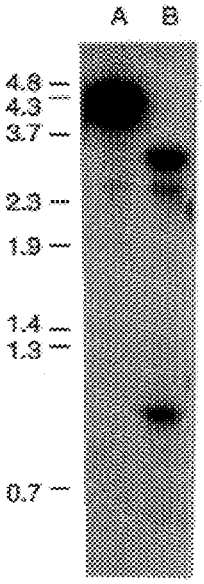
FIG. 8 is an autoradiograph of DNA from *T. longibrachiatum* strain P37PΔCBHIPyr$^{31}$ 26 transformed with EcoRI digested pPΔCBHII after Southern blot analysis using a $^{32}$p labelled pPΔCBHII as the probe. The sizes of molecular weight markers are shown in kilobase pairs to the left of the Figure.

DNA was extracted from strain P37PΔΔCBH67, digested with EcoRI and Asp718, and subjected to agarose gel electrophoresis. The DNA from this gel was blotted to a membrane filter and hybridized with $^{32}$p labelled pPΔCBHII (FIG. 8). Lane A of FIG. 8 shows the hybridization pattern observed for DNA from an untransformed *T. reesei* strain. The 4.1 kb EcoRI fragment containing the wild-type cbh2 gene was observed. Lane B shows the hybridization pattern observed for strain P37PΔΔCBH67. The single 4.1 kb band has been eliminated and replaced by two bands of approximately 0.9 and 3.1 kb. This is the expected pattern if a single copy of the EcoRI fragment from pPΔCBHII had integrated precisely at the cbh2 locus.

The same DNA samples were also digested with EcoRI and Southern blot analysis was performed as above. In this Example, the probe was $^{32}$P labelled pIntCBHII. This plasmid contains a portion of the cbh2 gene coding sequence from within that segment of the cbh2 gene which was deleted in plasmid pPΔCBHII. No hybridization was seen with DNA from strain P37PΔΔCBH67 showing that the cbh2 gene was deleted and that no sequences derived from the pUC plasmid were present in this strain.

While the invention has been described in terms of various preferred embodiments, the skilled artisan will appreciate that various modifications, substitutions, omissions, and changes may be made without departing from the spirit and scope thereof. Accordingly, it is intended that the scope of the present invention be limited solely by the scope of the following claims, including equivalents thereof.

What is claimed is:

1. A detergent composition comprising at least one surface active agent and a cleaning effective amount of a cellulase composition wherein said cellulase composition contains a weight ratio of exo-cellobiohydrolase I cellulase components to endoglucanase components of greater than about 10:1 to 400:1.

2. The detergent composition according to claim 1 wherein said detergent composition is substantially free of exo-cellobiohydrolase II cellulase components.

3. The detergent composition according to claim 2 wherein said weight ratio of exo-cellobiohydrolase I cellulase components to endoglucanase components is about 20:1 or more.

4. The detergent composition according to claim 3 wherein the weight ratio of said exo-cellobiohydrolase I cellulase components to said endoglucanase components is about 40:1 or more.

5. The detergent composition according to claim 1 wherein said composition is a liquid.

6. The detergent composition according to claim 1 wherein said composition is a powder.

7. The detergent composition according to claim 1 wherein said exo-cellobiohydrolase I cellulase components and said endoglucanase components are derived from a microorganism selected from the group consisting of *Trichoderma longibrachiatum*, Penicillium sp. and *Trichoderma koningii.*

8. The detergent composition according to claim 7 wherein said exo-cellobiohydrolase I cellulase components and said endoglucanase components are derived from *Trichoderma longibrachiatum.*

9. The detergent composition according to claim 8 wherein said exo-cellobiohydrolase I cellulase components and said endoglucanase components employed in the cellulase composition are obtained by purification from a *Trichoderma longibrachiatum* cellulase system having a distribution of components as follows:

| | |
|---|---|
| exo-cellobiohydrolase I | 45–55 weight percent |
| exo-cellobiohydrolase II | 13–15 weight percent |
| endoglucanase I | 11–13 weight percent |
| endoglucanase II | 8–10 weight percent |
| endoglucanase III | less than 4 weight percent |
| β-glucosidase | 0.5–1 weight percent. |

10. The detergent composition according to claim 1 wherein said composition is a laundry detergent composition.

11. The detergent composition according to claim 1 wherein said composition is a spot remover composition.

12. The detergent composition according to claim 1 wherein said composition is a presoak composition.

13. A method for enhancing the degradation resistance to cotton fabric of a detergent composition containing a cellulase which comprises:

(a) selecting a cellulase composition containing a weight ratio of exo-cellobiohydrolase I cellulase components to endoglucanase component of greater than about 10:1 to 400:1; and (b) adding said cellulase composition selected in (a) above to a detergent composition so as to form a degradation resistant detergent composition containing cellulase.

14. The method according to claim 13 wherein said exo-cellobiohydrolase I cellulase components are substantially free of exo-cellobiohydrolase II cellulase components.

15. The method according to claim 14 wherein the weight ratio of said exo-cellobiohydrolase I cellulase components to said endoglucanase components is about 20:1 or more.

16. The method according to claim 15 wherein the weight ratio of said exo-cellobiohydrolase I cellulase components to said endoglucanase components is about 40:1 or greater.

17. The method according to claim 13 wherein said detergent composition is a liquid.

18. The method according to claim 13 wherein said detergent composition is a powder.

19. The method according to claim 13 wherein said exo-cellobiohydrolase I cellulase components and said endoglucanase components are derived from a microorganism selected from the group consisting of *Trichoderma longibrachiatum,* Penicillium sp. and *Trichoderma koningii.*

20. The method according to claim 19 wherein said exo-cellobiohydrolase I cellulase components and said endoglucanase components are derived from *Trichoderma longibrachiatum.*

21. The method according to claim 20 wherein said exo-cellobiohydrolase I cellulase components and said endoglucanase components employed in the cellulase composition are obtained by purification from a *Trichoderma longibrachiatum* cellulase system having a distribution of components as follows:

| | |
|---|---|
| exo-cellobiohydrolase I | 45–55 weight percent |
| exo-cellobiohydrolase II | 13–15 weight percent |
| endoglucanase I | 11–13 weight percent |
| endoglucanase II | 8–10 weight percent |
| endoglucanase III | less than 4 weight percent |
| β-glucosidase | 0.5–1 weight percent. |

22. The method according to claim 13 wherein said detergent composition is a laundry detergent composition.

23. The method according to claim 13 wherein said detergent composition is a presoak detergent composition.

24. The method according to claim 13 wherein said detergent composition is a spot removing detergent composition.

25. A method for softening cotton fabric which comprises contacting said fabric with an aqueous solution containing a detergent composition comprising at least one surface active agent and a softening effective amount of a cellulase composition having a weight ratio of exo-cellobiohydrolase I cellulase components to endoglucanase components of greater than about 10:1 to about 400:1.

26. The method of claim 25 wherein said exo-cellobiohydrolase I cellulase components are substantially free of exo-cellobiohydrolase II cellulase components.

27. The method of claim 25 wherein the weight ratio of said exo-cellobiohydrolase I cellulase components to said endoglucanase components is about 20:1 or more.

* * * * *